US012421007B2

(12) United States Patent
Higginson

(10) Patent No.: US 12,421,007 B2
(45) Date of Patent: Sep. 23, 2025

(54) DEFORMABLE HYBRID RIGID STRUCTURE VESSELS

(71) Applicant: Timothy B. Higginson, Cohasset, MA (US)

(72) Inventor: Timothy B. Higginson, Cohasset, MA (US)

(73) Assignee: Timothy B. Higginson, Cohasset, MA (US)

( * ) Notice: Subject to any disclaimer, the term of this patent is extended or adjusted under 35 U.S.C. 154(b) by 169 days.

(21) Appl. No.: 17/963,831

(22) Filed: Oct. 11, 2022

(65) Prior Publication Data

US 2023/0174285 A1 Jun. 8, 2023

Related U.S. Application Data

(60) Provisional application No. 63/254,674, filed on Oct. 12, 2021.

(51) Int. Cl.
*B65D 79/00* (2006.01)
*B65D 8/00* (2006.01)

(52) U.S. Cl.
CPC ..... *B65D 79/0084* (2020.05); *B65D 15/10* (2013.01); *B65D 15/24* (2013.01)

(58) Field of Classification Search
CPC .... B65D 79/0084; B65D 15/10; B65D 15/24; B65D 21/086; B65D 1/44; B65D 1/0223
USPC ..... 215/379
See application file for complete search history.

(56) References Cited

U.S. PATENT DOCUMENTS

2020/0255183 A1* 8/2020 Tsui ..... B29C 45/0081

* cited by examiner

*Primary Examiner* — Anthony D Stashick
*Assistant Examiner* — L Kmet
(74) *Attorney, Agent, or Firm* — Leydig, Voit & Mayer, Ltd.

(57) ABSTRACT

A container vessel is described that includes a resiliently deformable wall having a surface area where a majority of the surface area is occupied by a plurality of rigid panes connected by a resilient flexible membrane so that the wall is capable of recovering to an original shape after substantial deformation in either or both a vertical dimension and a horizontal dimension by the application of external pressure and. The primary structural components include: a matrix of rigid panes, each of which is separated by, and connected by, a resilient flexible frame.

13 Claims, 52 Drawing Sheets

DEFORMABLE HYBRID RIGID STRUCTURE VESSELS

CROSS-REFERENCE TO RELATED APPLICATIONS

This patent application claims the benefit of U.S. Provisional Patent Application No. 63/254,674, filed Oct. 12, 2021, entitled "DEFORMABLE HYBRID RIGID STRUCTURE VESSELS", which is expressly incorporated herein by reference in its entirety, including any references therein.

FIELD OF THE INVENTION

The present disclosure generally relates to deformable hybrid rigid structure vessels, such as squeezable glass and aluminum bottles.

BACKGROUND

Known glass bottles, while offering exceptional recycling, non-contaminating interiors and low-cost materials and construction and see-through sides and a reasonably wide variety of shapes and colors, are missing key qualities in comparison with plastic containers, especially weight and the ability to be squeezed.

Glass bottles are heavier, leading to higher transportation costs and more difficulty for people to carry them. When they break, they can shatter into many large and small pieces of glass. Further, it can be harder to design them to have a wide range of handles and other industrially designed protrusions.

Aluminum vessels, such as aluminum cans and bottles, are lightweight and recyclable, but tend to dent and crinkle when squeezed, and are not see-through, among other drawbacks.

In contrast, plastic bottles can be lighter weight, are squeezable and can be constructed with a wide range of protrusions, shapes and handles.

However, plastic bottles have several drawbacks. These drawbacks include, for instance: (1) poor recycling capabilities, especially depending on the type of plastic used; (2) extensive harm to the environment (land and ocean) due to the extended time (frequently centuries) it takes for them to degrade, even in landfills, but also in the ocean, (3) oil and gas extraction environmental repercussions, (4) refinery environmental repercussions, and (5) micro-particles entering the food chain through multiple channels (water, direct ingestion, air, etc) with harmful health consequences for humans and animal life.

Further, in general, except for caps/tops, vessels made of any of glass, aluminum and/or plastics tend to be constructed of one primary material, limiting the vessel to the structural and other characteristics (eg, construction, transportation, recycling and environmental) of that single material.

BRIEF SUMMARY OF THE INVENTION

The present disclosure provides deformable hybrid rigid closable containers. The hybrid rigid closable container exhibits a structural arrangement including a combination of rigid structural elements ("panes") that constitute a majority of the surface area of one or more sidewalls of the closable container. The rigid structural elements are incorporated within a framework of resilient material ("frame"). The resulting hybrid container side may be combined further with a rigid base and/or a rigid top, and furthermore rigid structural elements making up the sides, base and top of the container may be comprised of any type or combination of materials best suited to the specific use case.

As such, the present disclosure relates to a container vessel that includes a resiliently deformable wall having a surface area where a majority of the surface area is occupied by a plurality of rigid panes connected by a resilient flexible membrane so that the wall is capable of recovering to an original shape after substantial deformation in either or both a vertical dimension and a horizontal dimension by the application of external pressure and. The primary structural components include: a matrix of rigid panes, each of which is separated by, and connected by, a resilient flexible frame.

BRIEF DESCRIPTION OF THE DRAWINGS

While the appended claims set forth the aspects of the present invention with particularity, the invention and its advantages are best understood from the following detailed description taken in conjunction with the accompanying drawings, of which:

DESCRIPTION OF ILLUSTRATIVE EXAMPLES DEPICTED IN THE DRAWINGS

Figure 1:
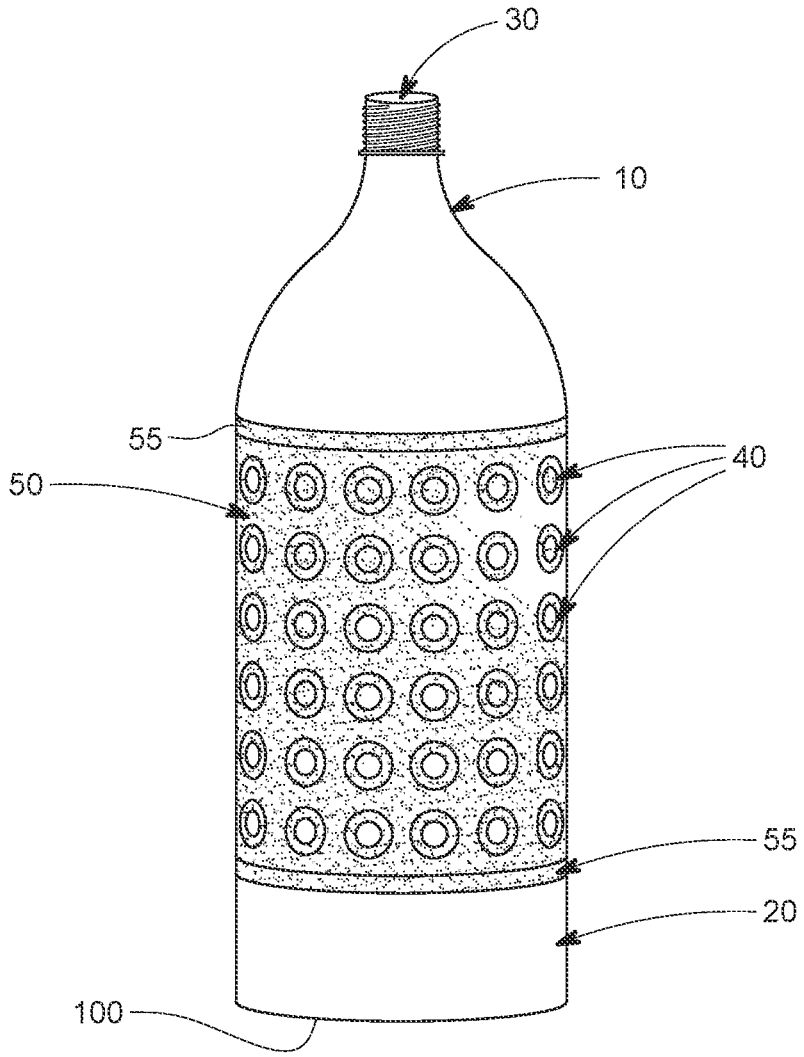
FIG. 1 depicts a perspective view of a deformable hybrid rigid structure vessel in an implementation in the form of a bottle with a uniform matrix of rigid panes set in a flexible frame and with rigid top and bottom pieces.

Turning to FIG. 1, a perspective side view is provided of a deformable hybrid rigid structure vessel 100 in an implementation form of a bottle with a uniform matrix of rigid panes 40 set in a flexible membrane frame 50 and with a rigid top piece 10 and a rigid bottom piece 20.

An array of rigid panes 40 is constructed so that each pane is attached to other panes, and the top and bottom pieces by a resilient self-righting, elastic, flexible and deformable membrane frame. The construction is such that each pane frame is only connected to the resilient frame, and not to any other pane of the frame.

The material of the frame is constructed of an elastic material that is fixably adhered to the circumference edges of each pane (and lower circumference edge of the top rigid non-pane piece and the upper circumference edge of the bottom rigid non-pane piece).

The precise specifications utilized in the elastic material are selected according to the specific use and/or purpose of the vessel, including, for instance, (a) the designed degree of inward deformation; (b) the designed resistance to inward deformation; (c) the designed speed of re-bound to the array's standing original shape; (d) a food quality material; (e) a material that degrades quickly in various environments (e.g., landfills or immersive liquid solutions); and (d) a material that does not degrade by the liquid to be held in the vessel. An example frame material is silicone.

The rigid non-pane top 10 is constructed of aluminum, glass, plastic or other rigid material with properties corresponding to the specific purpose of the vessel. The rigid non-pane bottom/base 20 is constructed of aluminum, glass, plastic or other rigid material with properties corresponding to the specific purpose of the vessel. The rigid top 10 and rigid bottom 20 are constructed of the same or different rigid materials corresponding to the specific purpose of the vessel. The rigid top 10 can have a screw top, an opening sealed with a cork or other stopper or other insertable plug or other suitable closure mechanism.

Figure 2:
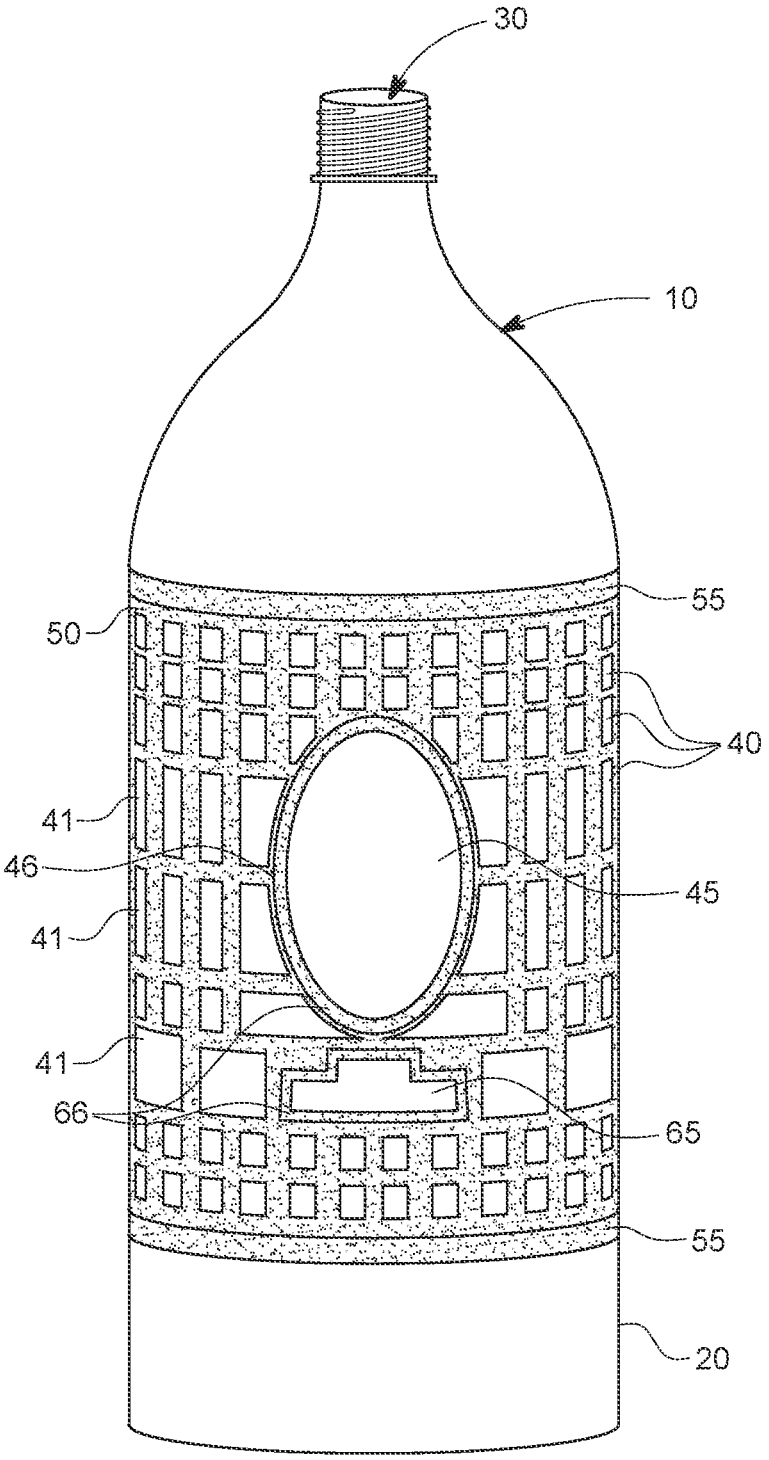
FIG. 2 depicts a perspective view of a deformable hybrid rigid structure vessel in an implementation form of a bottle with a matrix of rigid panes of variable sizes and shapes (some asymmetric) set in a flexible frame and with rigid top and bottom pieces.
Figure 3A:
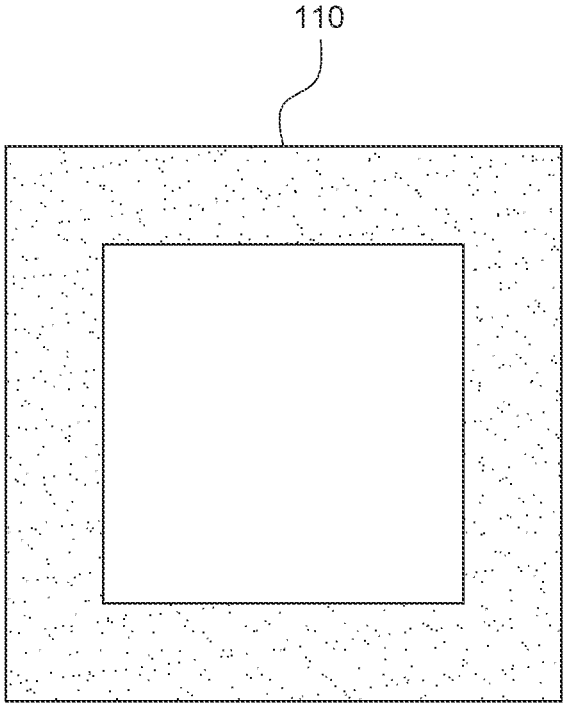
FIGS. 3*a* to 3*h* depict a variety of pane shapes and sizes.
Figure 3B:
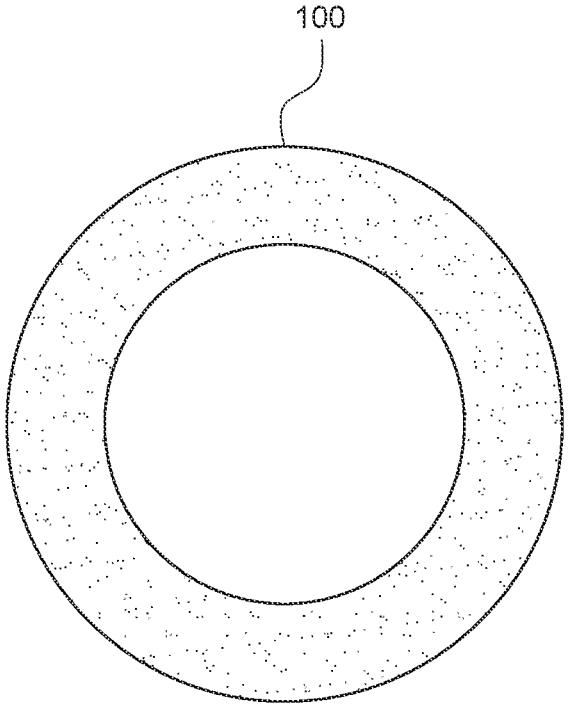
Figure 3C:
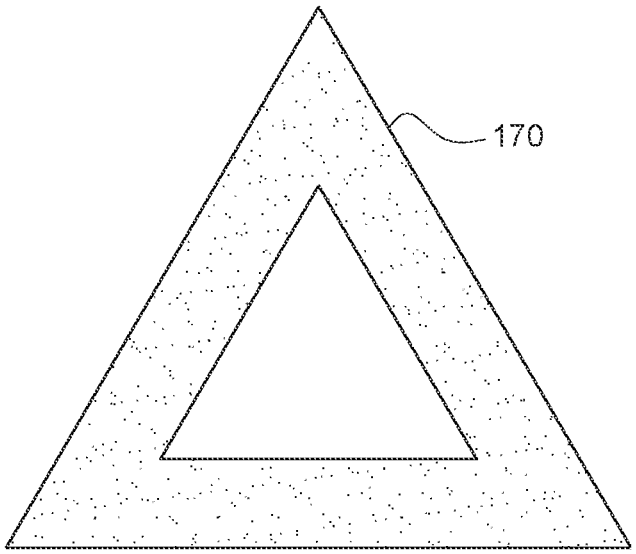
Figure 3D:
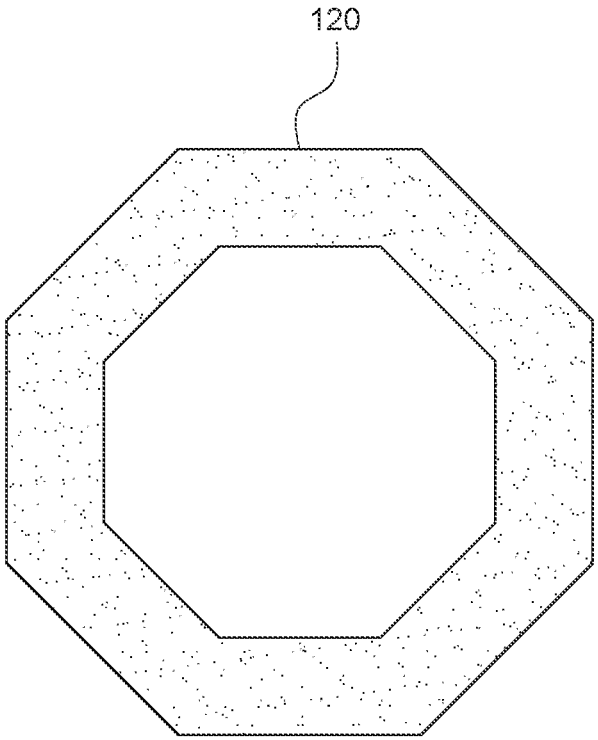
Figure 3E:
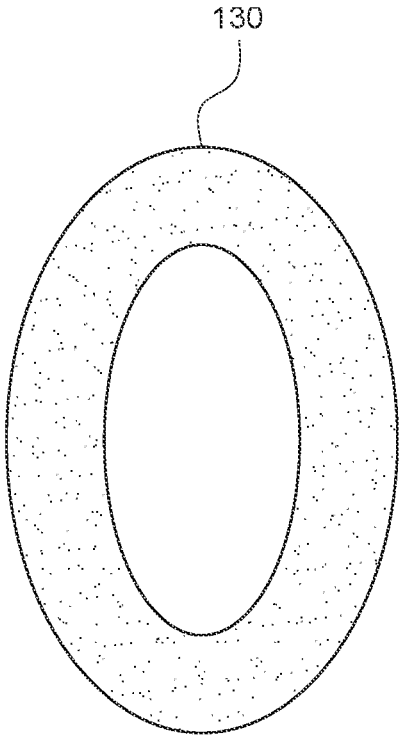
Figure 3F:
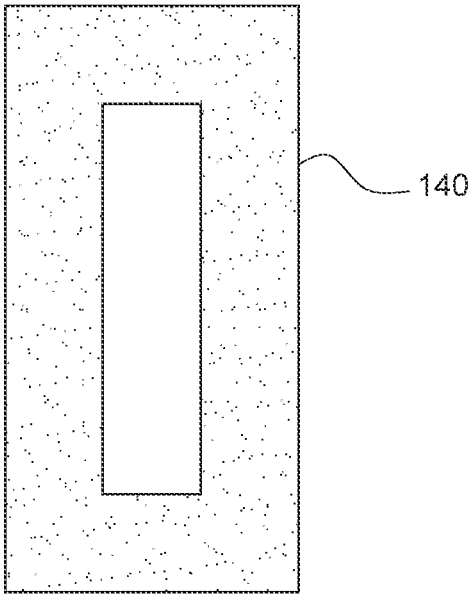
Figure 3G:
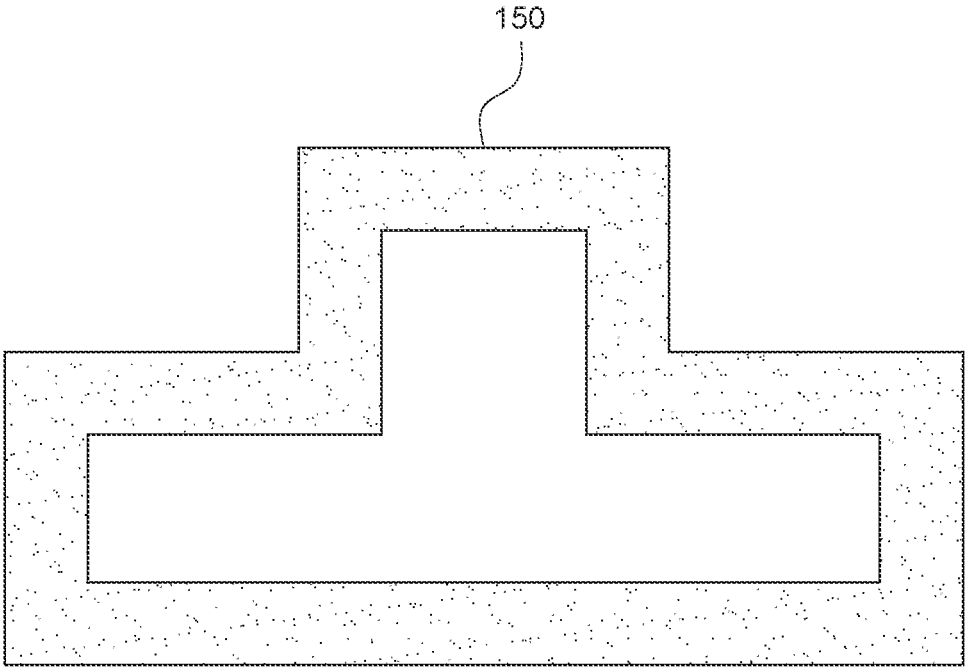
Figure 3H:
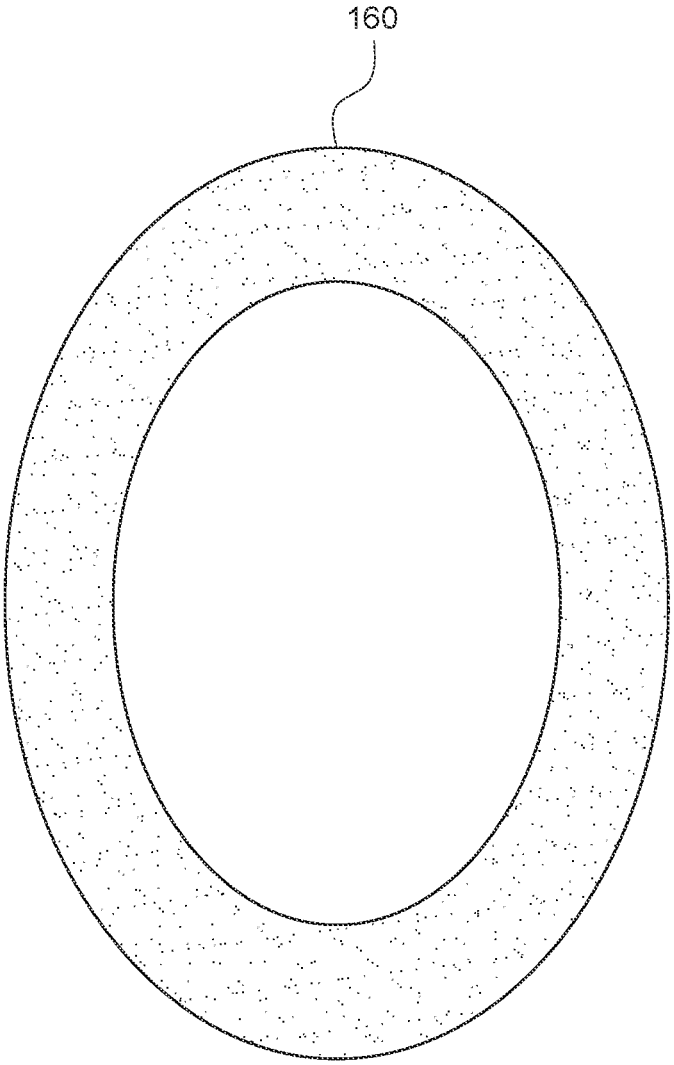

FIG. 2 depicts a side view of a deformable hybrid rigid structure vessel in an implementation form of a bottle with a matrix of rigid panes 40 of variable sizes and shapes (some asymmetric) set in a flexible frame 50 and with rigid top/neck and pouring piece 10 and bottom/base pieces 20. The top piece includes an overlapping attachment area 55 for a portion of the frame 50. The rigid panes are of various sizes and shapes 40, 41, 65 wherein each individual pane has a circumference area of overlap and liquid-sealed attachment of the frame (e.g., 66). A large oval pane 45 is approximately centered in the pane matrix such that a label may be affixed thereto and further such that pane 45 provides an oriented point of pressure for squeezing inwardly by hand/finger pressure. Other shapes of panes are further depicted (e.g., 40, 41, 65) such that the pane matrix consists of an array of panes of sizes and shapes applicable to the desired shape and functionality of the overall vessel. The frame 50 overlaps and connects all panes and the top 10 and bottom 20 of the vessel without any of the panes, top or bottom physically touching or connecting to another pane while providing a self-righting (in all dimensions) integral structure of a deformable rigid pane, water-tight vessel. The panes and top and bottom pieces may be constructed of any mix of rigid materials, including, but not limited to, glass, aluminum, steel, ceramics, as suitable for the intended use of the vessel. The size and shape of the vessel, the presence of handles (attached to or integrally a part of the top piece, bottom piece and/or one or more panes) or other protrusions or concavities are incorporated again as suitable for the intended use of the vessel.

FIGS. 3*a* to 3*h* depict top views of a variety of pane shapes and sizes. Pane shape and sizes, thicknesses, colored or clear, materials (eg, glass, metals, ceramics, etc), ratio of area uncovered by a frame to area covered by and attachable connected to a frame, are all determined by the purpose and desired functionality and deformable/squeezable specifications of any particular use case of a vessel.

Figure 4A:
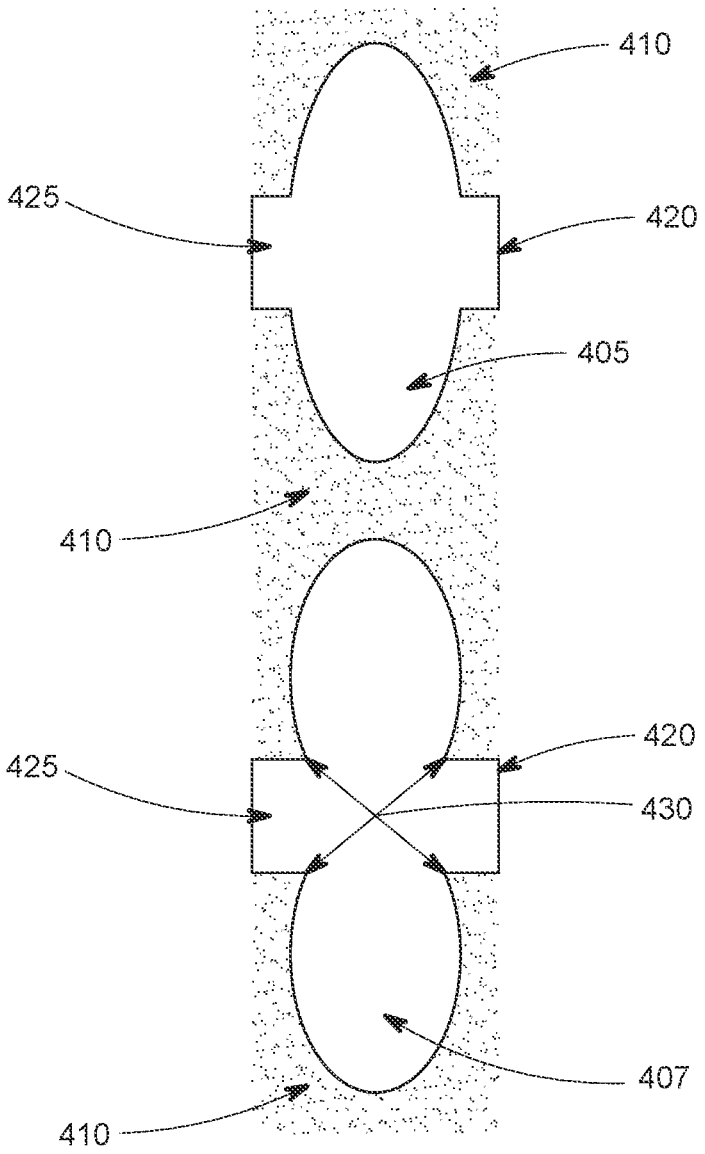
FIGS. 4*a* and 4*b* depict cross-section cut-away views of a set of rigid panes embedded in flexible frames.

FIG. 4*a* depicts a side view and cut-away views of a set of 2 non-identical rigid panes embedded in flexible frame 410. A pane 405 is depicted with a flat internal surface 425 and a flat external surface 420 that is a raised surface differentiated from the surface area overlapped by the frame 410 and wherein the flexible frame's surface matches raised non-overlapping internal surface 425 and external surface 420 of the pane. Further, the two panes 405, 407 are separated by the frame of resilient (e.g., silicone) material and, hence, are not directly touching or connected. Pane 407 additionally has indents at the corners 430 of the raised internal and external areas thereby providing an additional point of attachment for the frame to the pane.

Figure 4B:
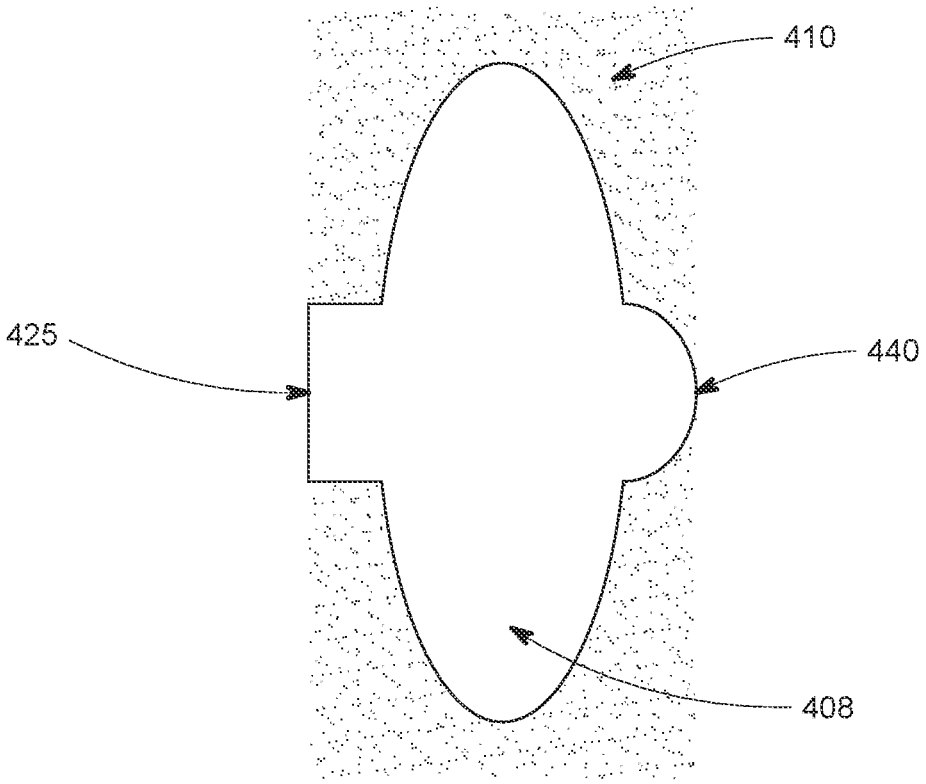

FIG. 4*b* depicts a side view of a single pane 408 wherein the external surface 440 of the pane that is not attached to and covered by the frame 410 is convex, while the internal surface 425 of the pane is flat. This design provides a flat contiguous surface area on the inside of the vessel, while the external surface incorporates panes with domed or other external surface area for purposes, for instance, of extra grip and/or grip orientation by touch.

Figure 5:
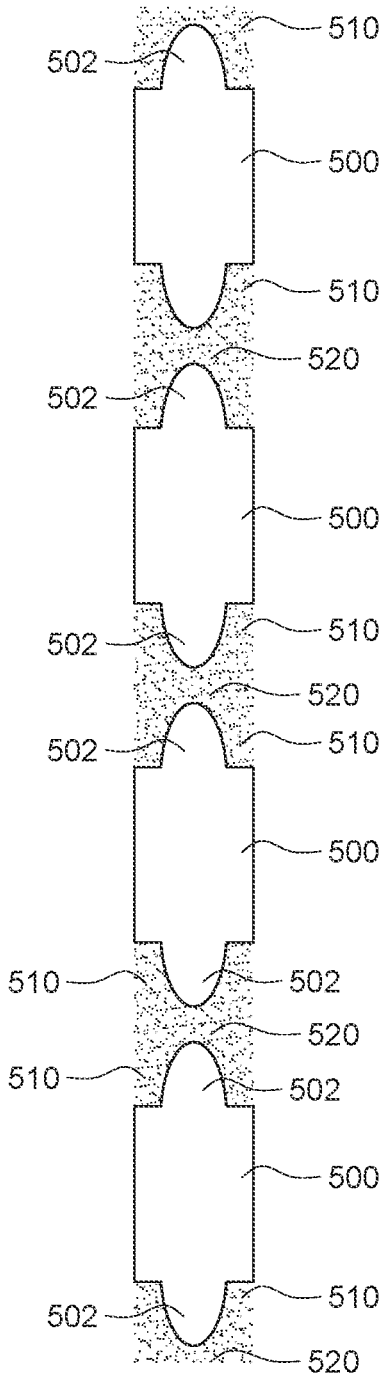
FIG. 5 depicts a side, cross-section cut-away view of a wall of panes embedded in a flexible frame.

FIG. 5 depicts a side, cut-away view of a wall of panes embedded in a flexible frame. In this instance, 4 identical panes 500 are connected flexibly and elastically by a contiguous frame 510. The frame overlaps and connects to each pane on the internal and external of a surface area 502 of each pane. The ratio of area of separation of the panes consisting of the frame to the size of each of the panes is determined by the degree of flex and self-righting specifications of the vessel's intended purpose.

Figure 6:
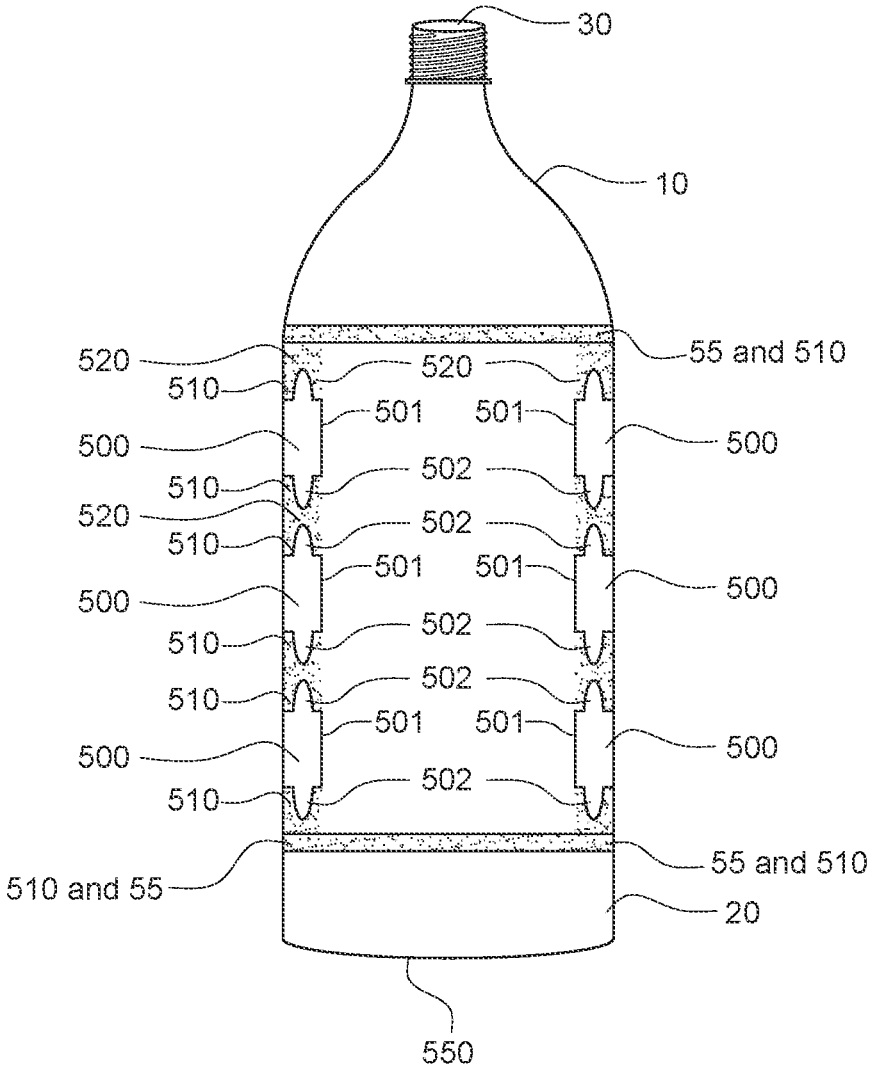
FIG. 6 depicts a perspective side cut-away view of a deformable hybrid rigid structure vessel implementation in a form of a bottle with a uniform matrix of rigid panes set in a flexible frame and with rigid top and bottom pieces.
Figure 7A:
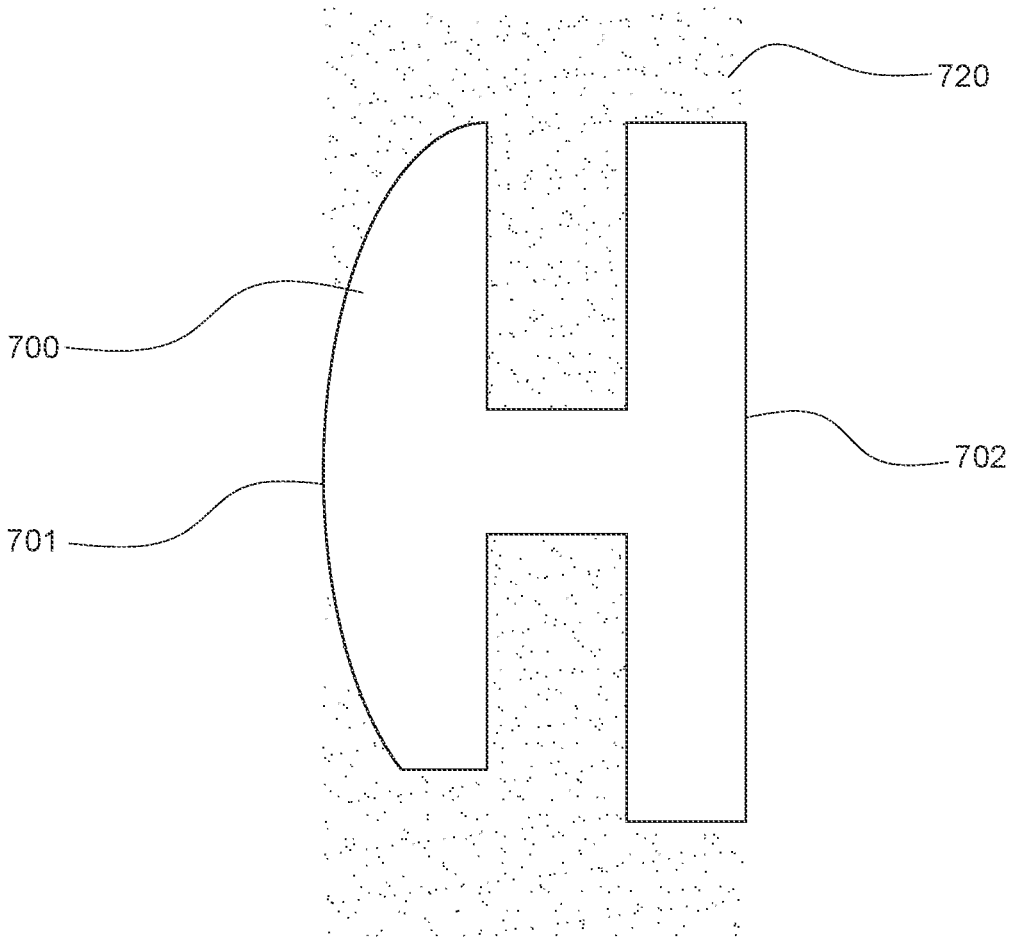
FIGS. 7*a* to 7*e* depict a set of side cut-away views of a variety of shapes of panes embedded in a flexible frame.
Figure 7B:
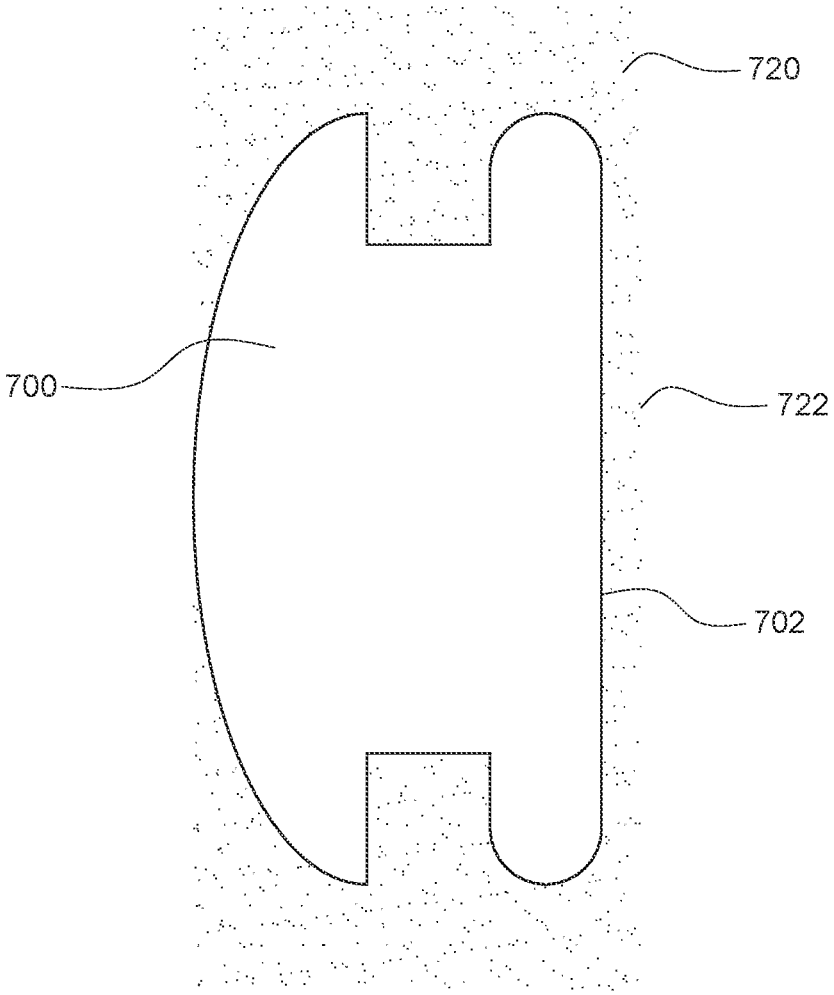
Figure 7C:
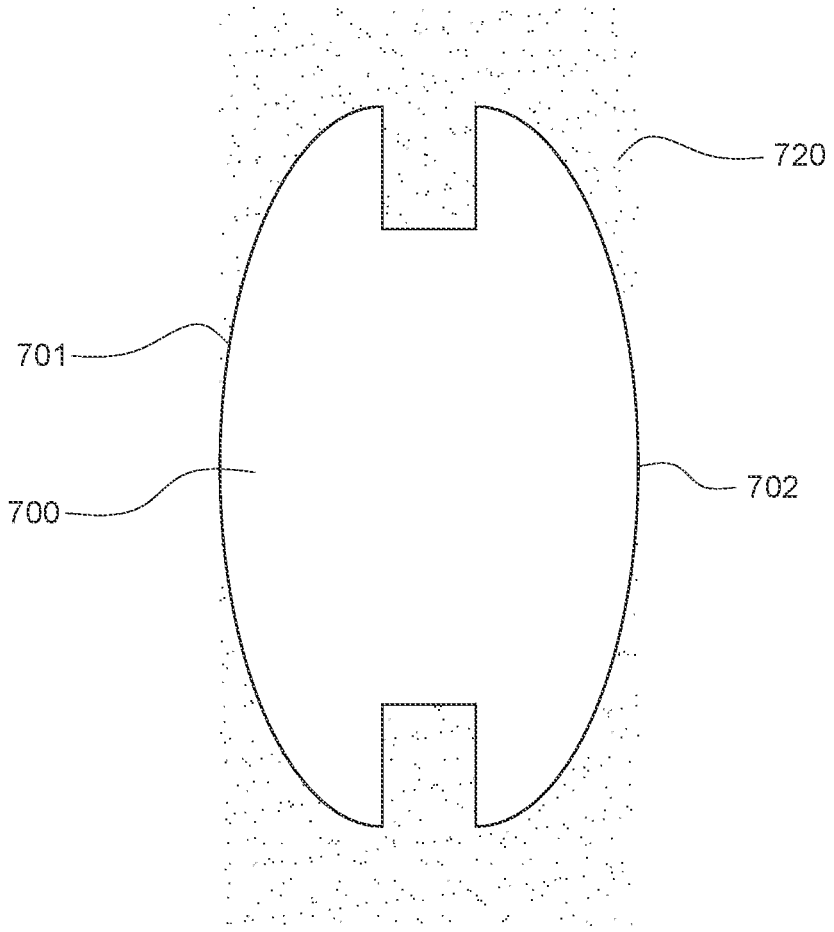
Figure 7D:
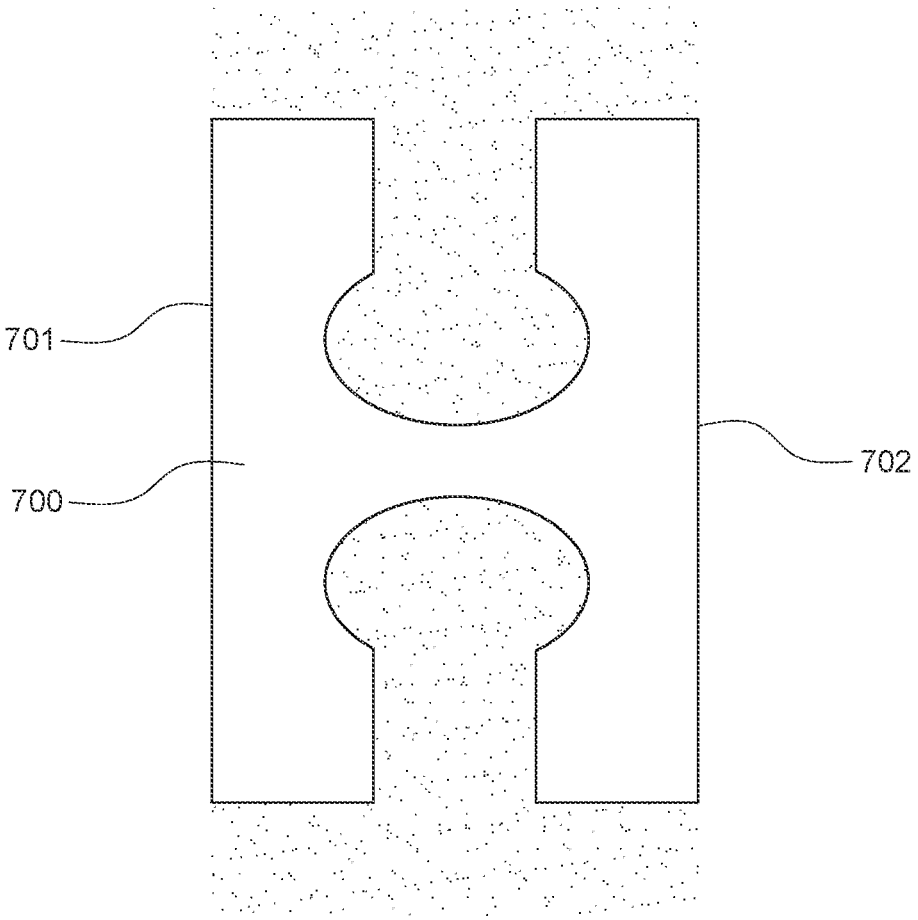
Figure 7E:
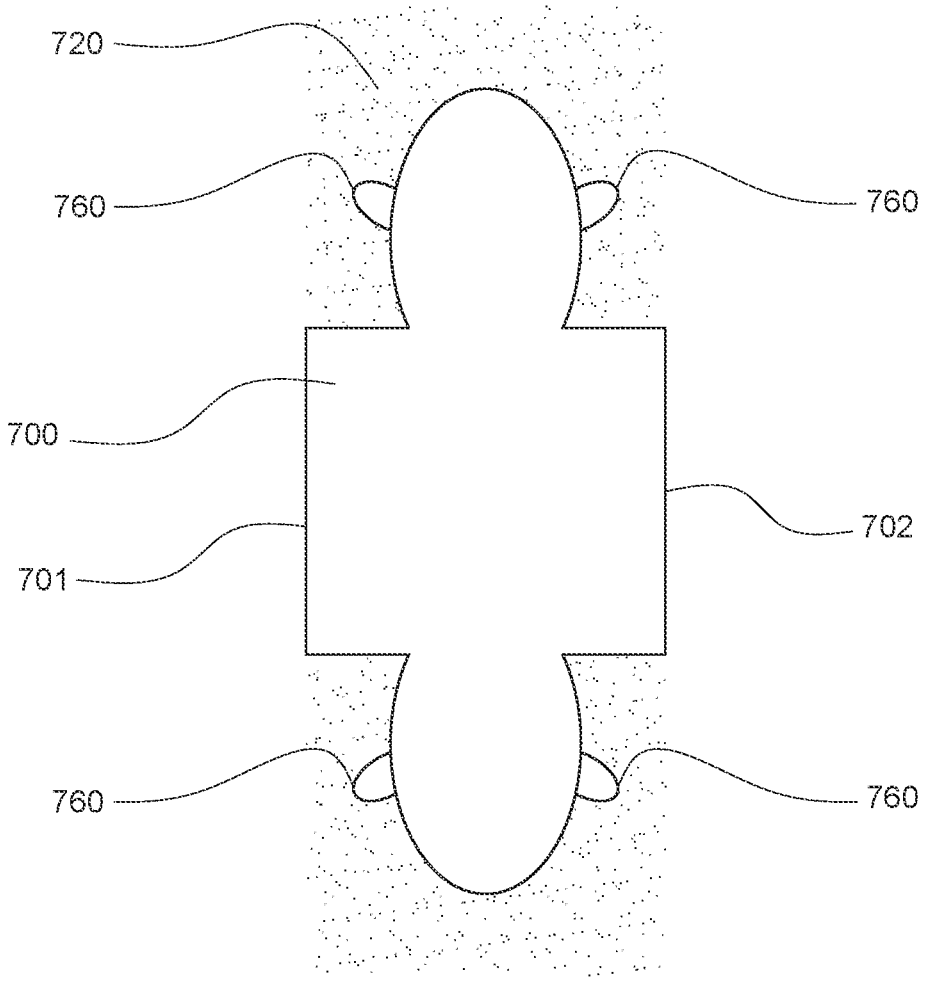
Figure 8A:
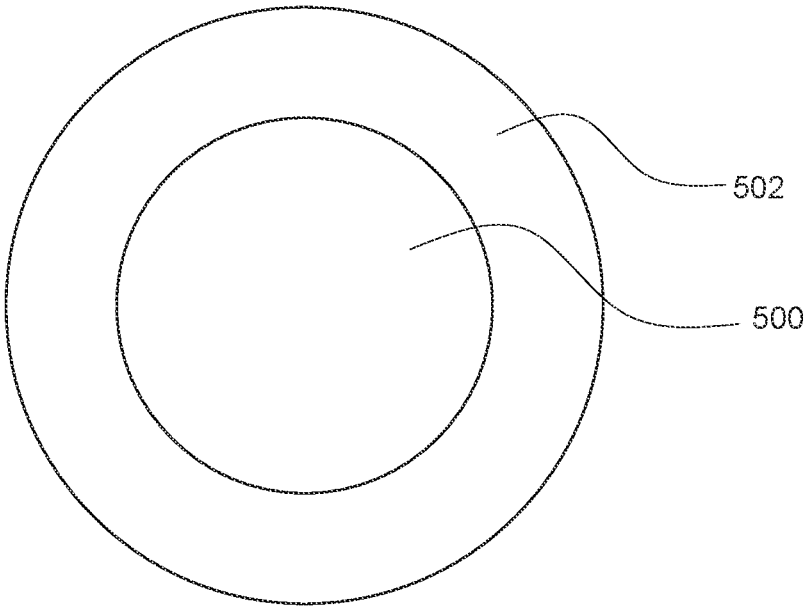
FIGS. 8*a* to 8*e* depict a series of views for a round pane element, including top and side views of the round pane.
Figure 8B:
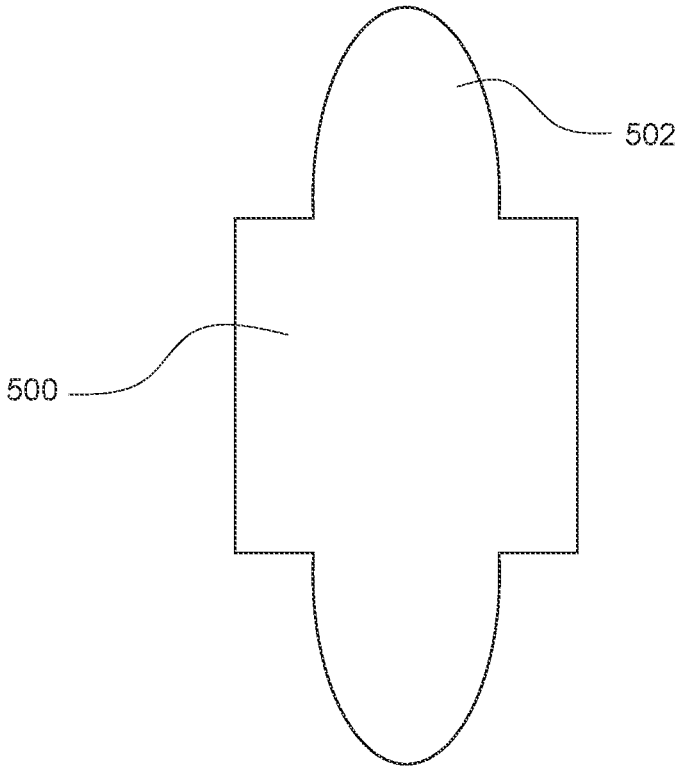
Figure 8C:
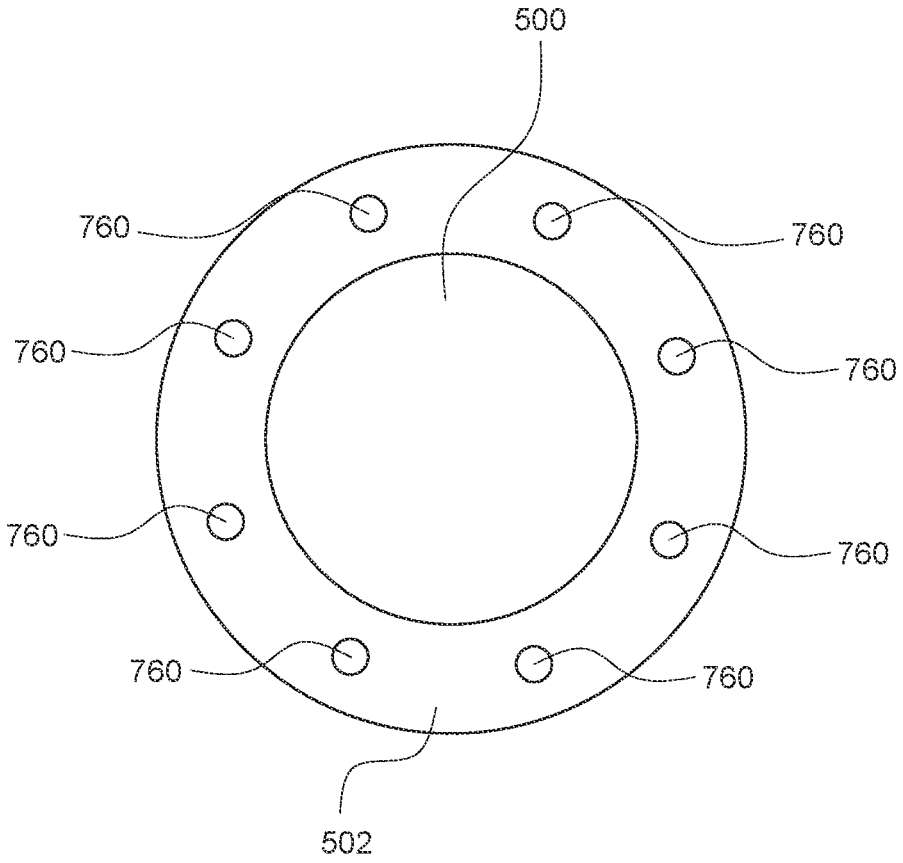
Figure 8D:
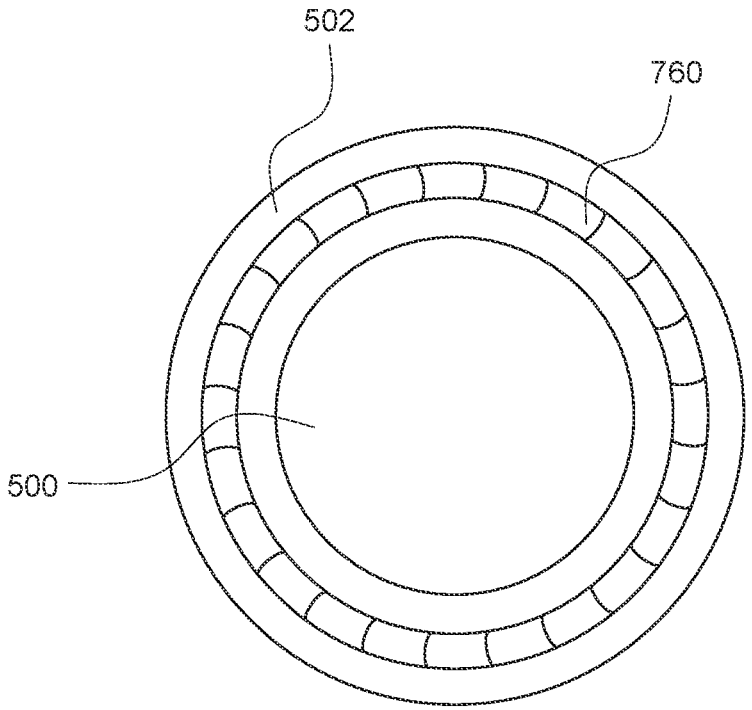
Figure 8E:
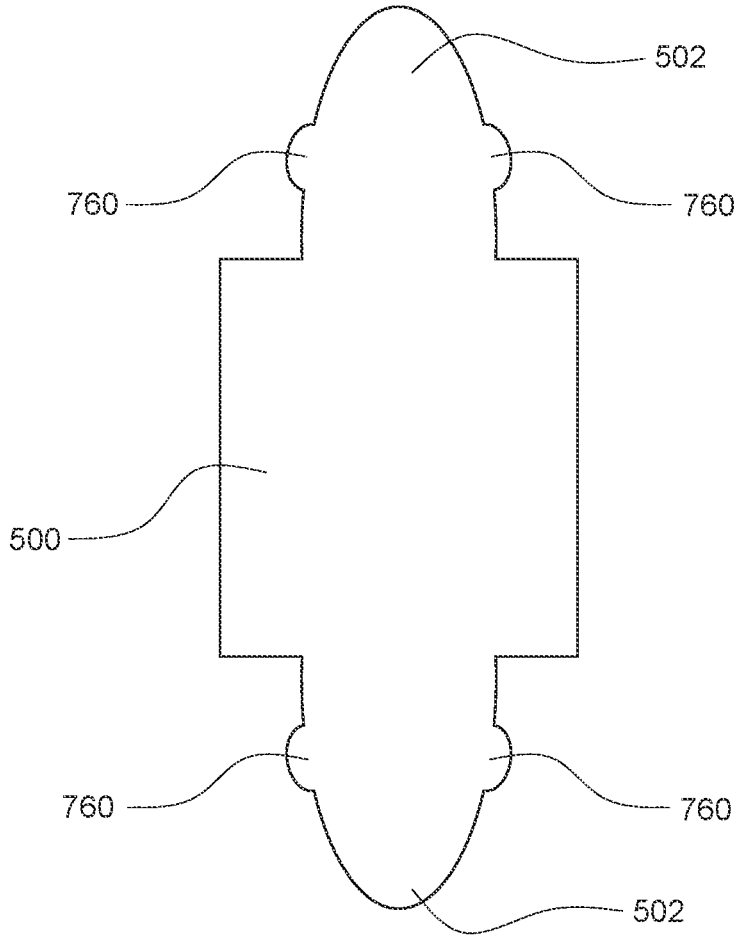

FIG. 6 depicts a side cut-away view of a deformable hybrid rigid structure vessel in an implementation form of a bottle with a uniform matrix of rigid panes 500 set in a flexible frame 520 and with rigid top 10 and bottom pieces 550. Each pane incorporates an overlap area 502 with the frame 520 which overlap area is an integral part of each pane and wherein the non-overlapped internal surface 501 of each pane is flat. The top piece 10 of the vessel includes an opening area 30, which may include a closure mechanism, such as a lid, screw top, flip top, removable cap, cork, or other closure mechanism applicable to the context. The top piece 10 further includes an area above (and not directly connected with/to) the matrix/array of panes wherein a sealed, flexible connection between the top piece 10 and the array of panes is the frame 520 and wherein the top piece 10 has an overlap area 55 (and 510) whereby the frame is sealably attached to the top piece 10. The bottom piece 550 provides a single structural base (which, alternatively could be a matric of panes connected by a frame, depending on the use case) and includes an area below (and not directly connected with/to) the matrix/array of panes wherein a sealed, flexible connection between the bottom piece 550 and the array of panes is the frame 55 (and 510) and wherein the bottom piece 550 has an overlap area 55 (and 510) whereby the frame is sealably attached to the bottom piece 550.

FIGS. 7*a* to 7*e* depict a side cut-away view of a variety of shapes of panes embedded in a flexible frame. Individual panes 700 of a variety of shapes incorporate overlap areas of a variety of designs to flexibly and sealably attach to a frame 720. The selected material, size and shape of a pane impacts the connection/overlap design with the frame. For instance, a small glass pane is likely to utilize a design where stresses imparted by the flexing, stretching and re-bounding of the frame do not structurally challenge the pane, whereas a pane made of steel enables different pane shapes for frame attachment purposes.

FIGS. 8*a* to 8*e* depict top and side views of a round pane 500 wherein an overlapping area 502 with a frame incorporates any of a variety of protrusions for anchoring the frame to the pane.

Figure 9A:
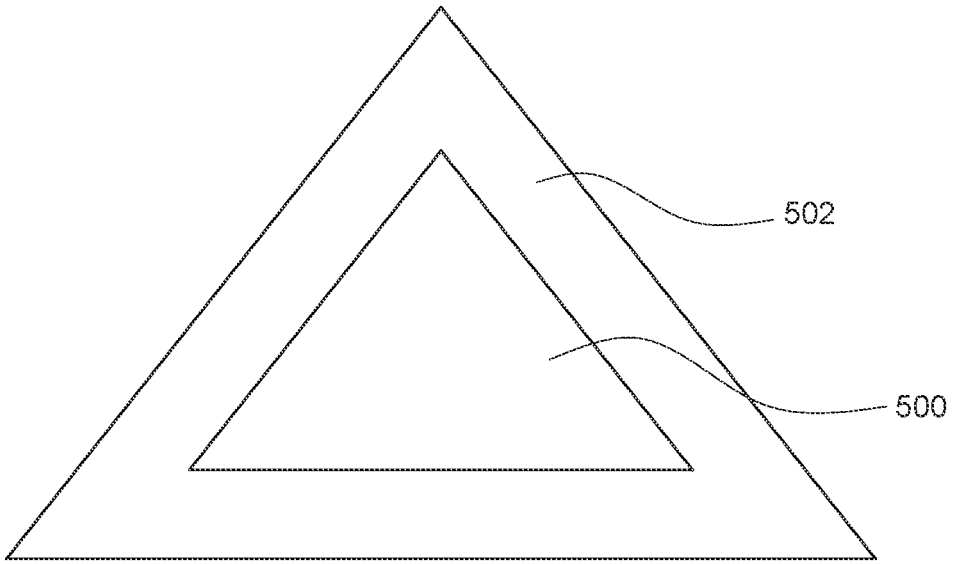
FIGS. 9*a* to 9*c* depict a series of view for a triangular pane element, including top and side views of a triangular pane, and a matrix of a matrix of triangular panes embedded in a frame forming an impermeable, deformable, self-righting wall.

FIG. 9*a* depicts a top view and a side view of a triangular pane 500 with a circumference area 502 for attachment and overlap of a frame.

Figure 9B:
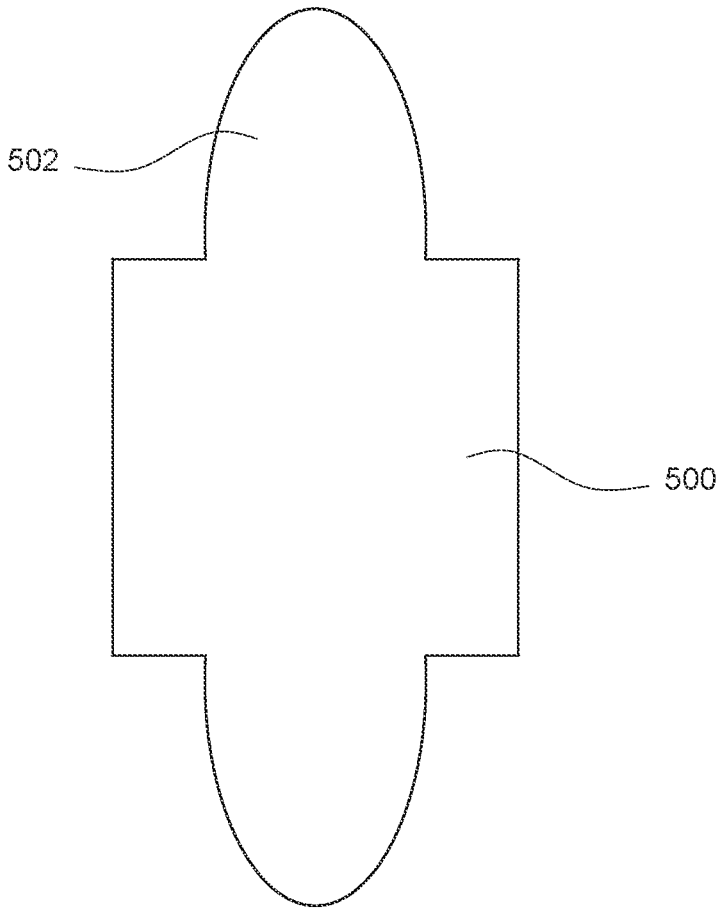
Figure 9C:
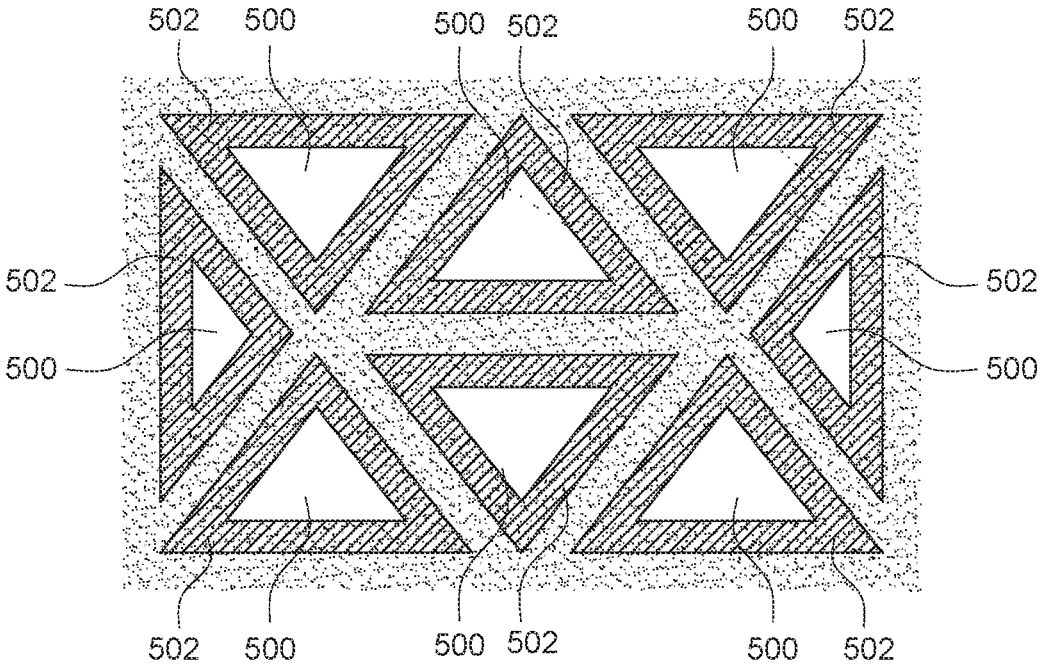

FIG. 9*b* depicts a matrix/array/grid of triangular panes 500 embedded in a frame 510 forming an impermeable, deformable, self-righting wall. Each pane 500 incorporates an integral circumference area 502, where the pane is overlapped by and fixable attached to the frame 510.

Figure 10A:
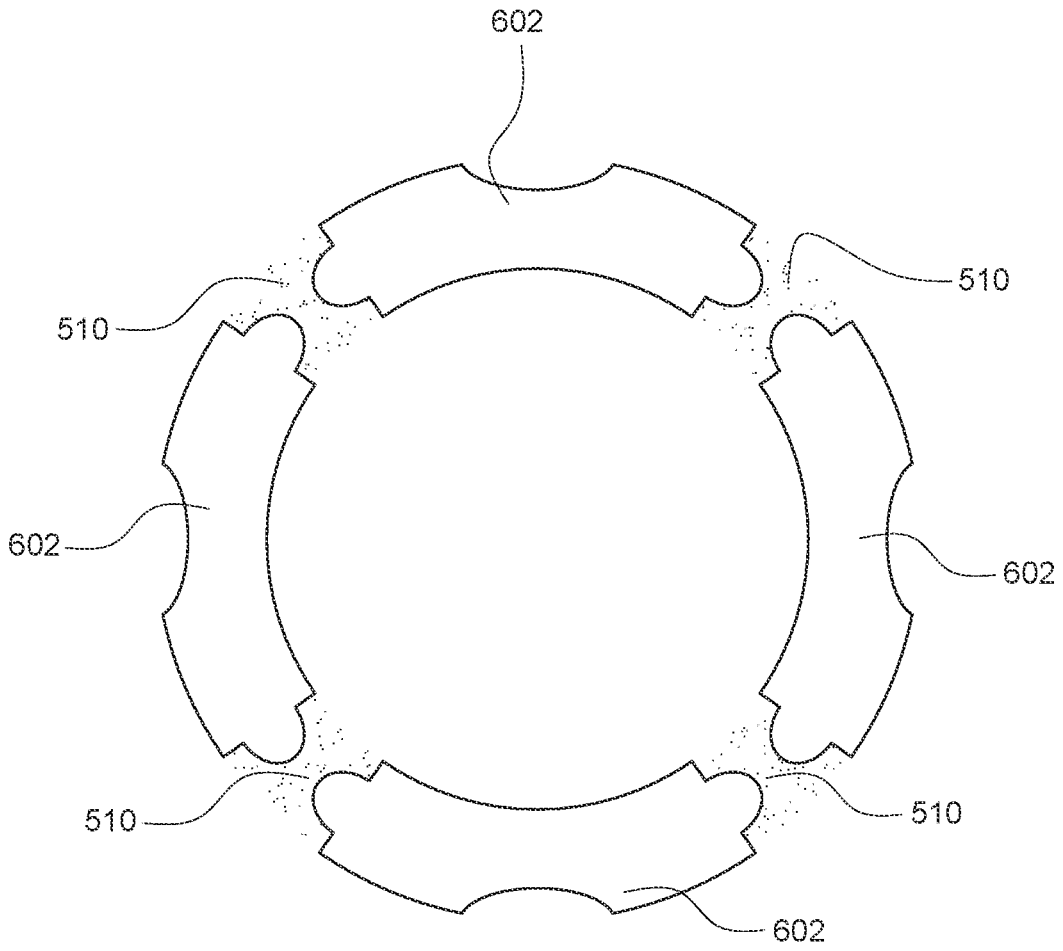
FIGS. 10*a* to 10*f* depict multiple side views of a variety of shapes of panes and membrane walls.
Figure 10B:
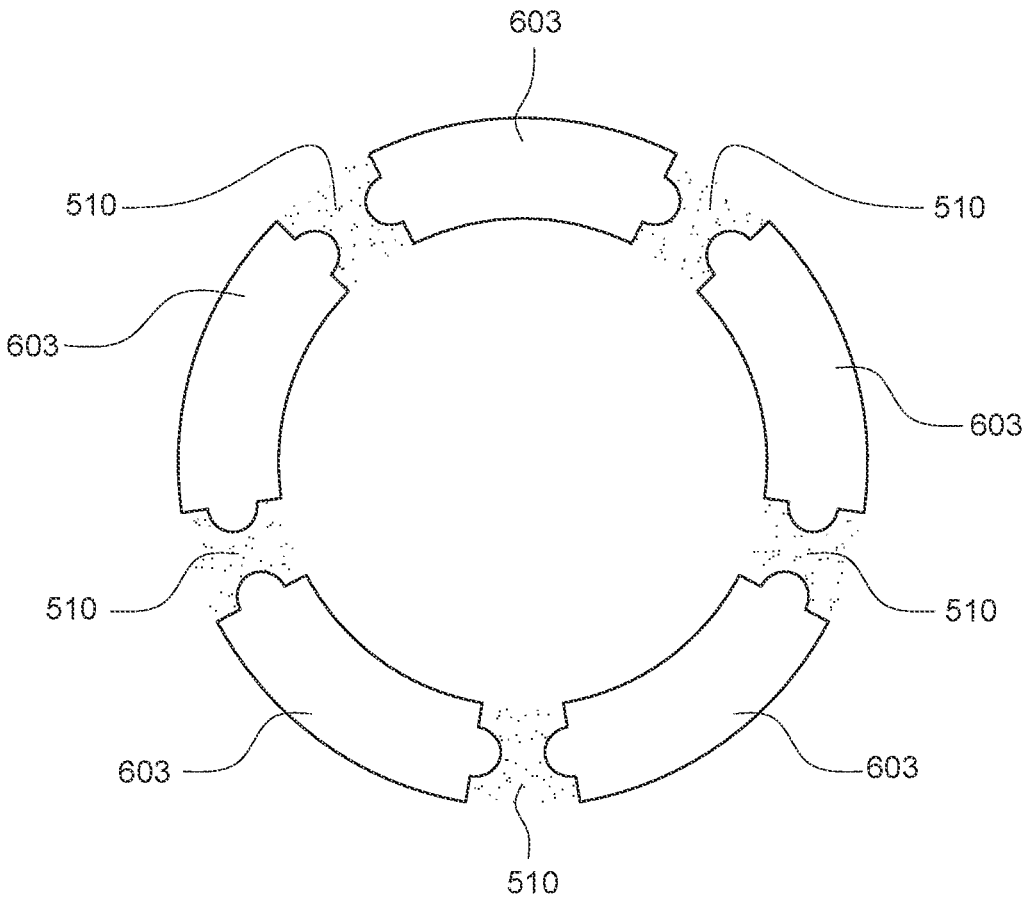
Figure 10C:
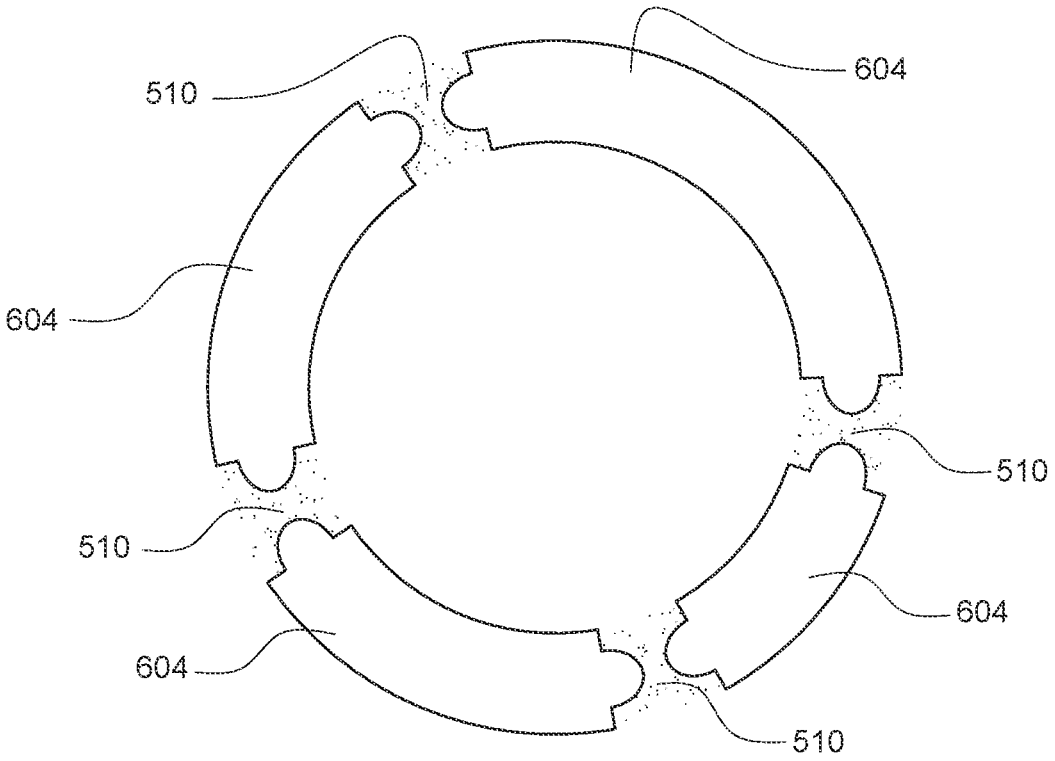
Figure 10D:
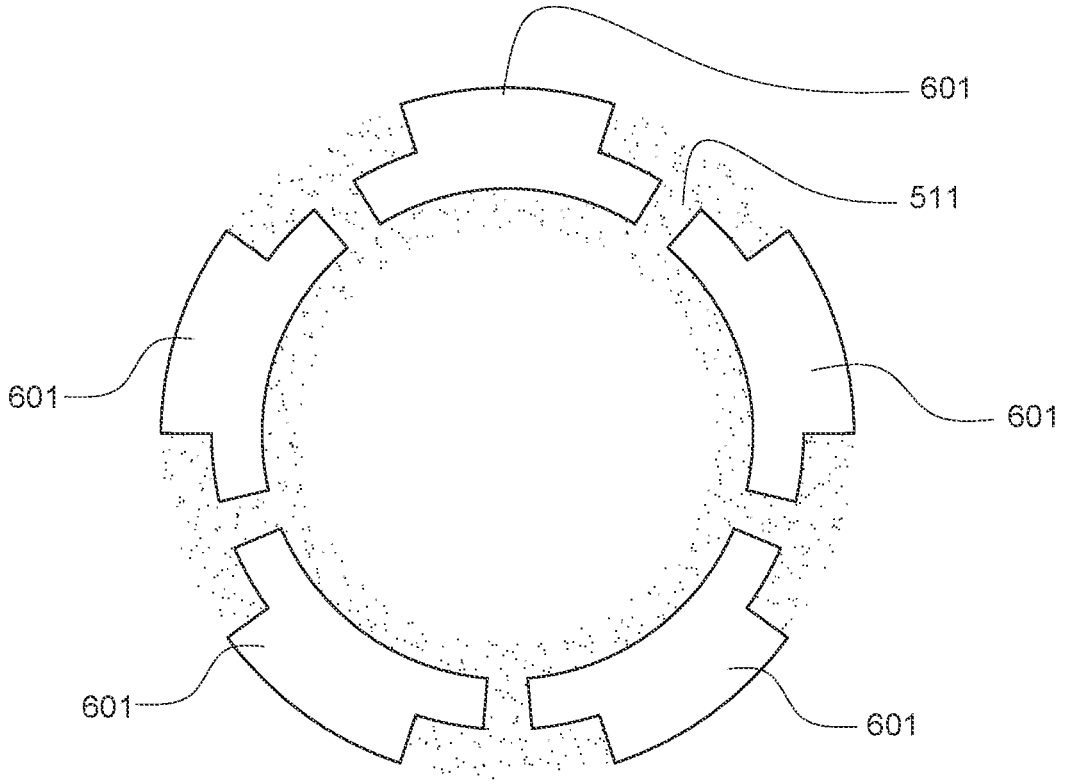
Figure 10E:
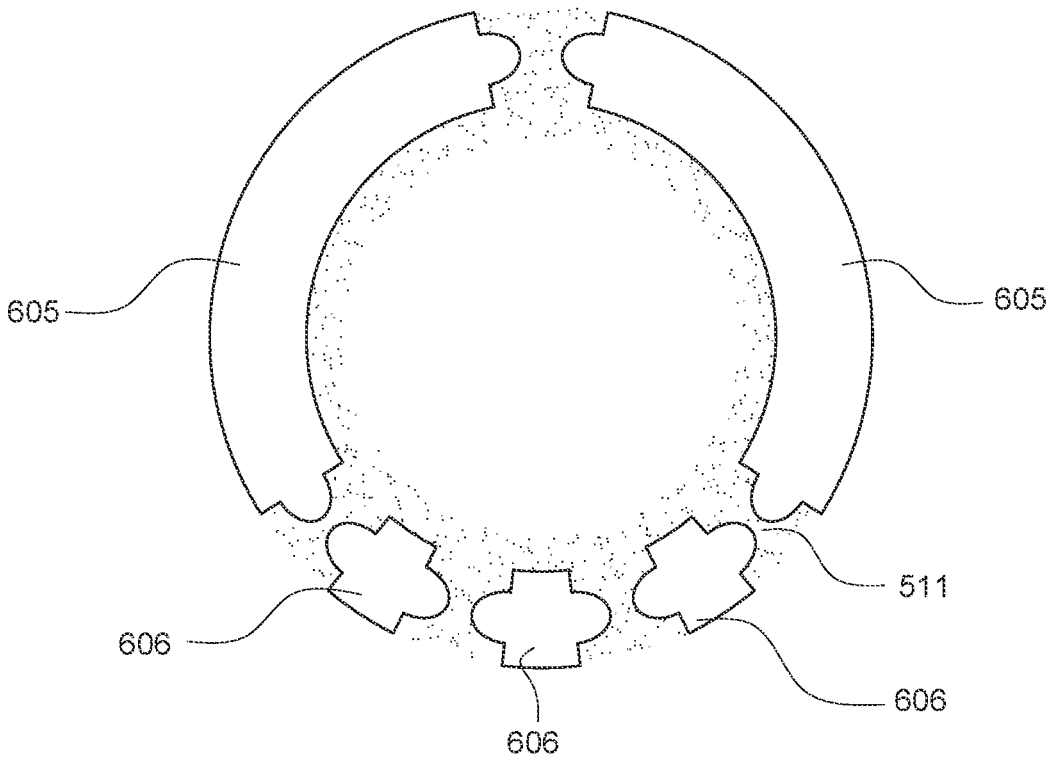
Figure 10F:
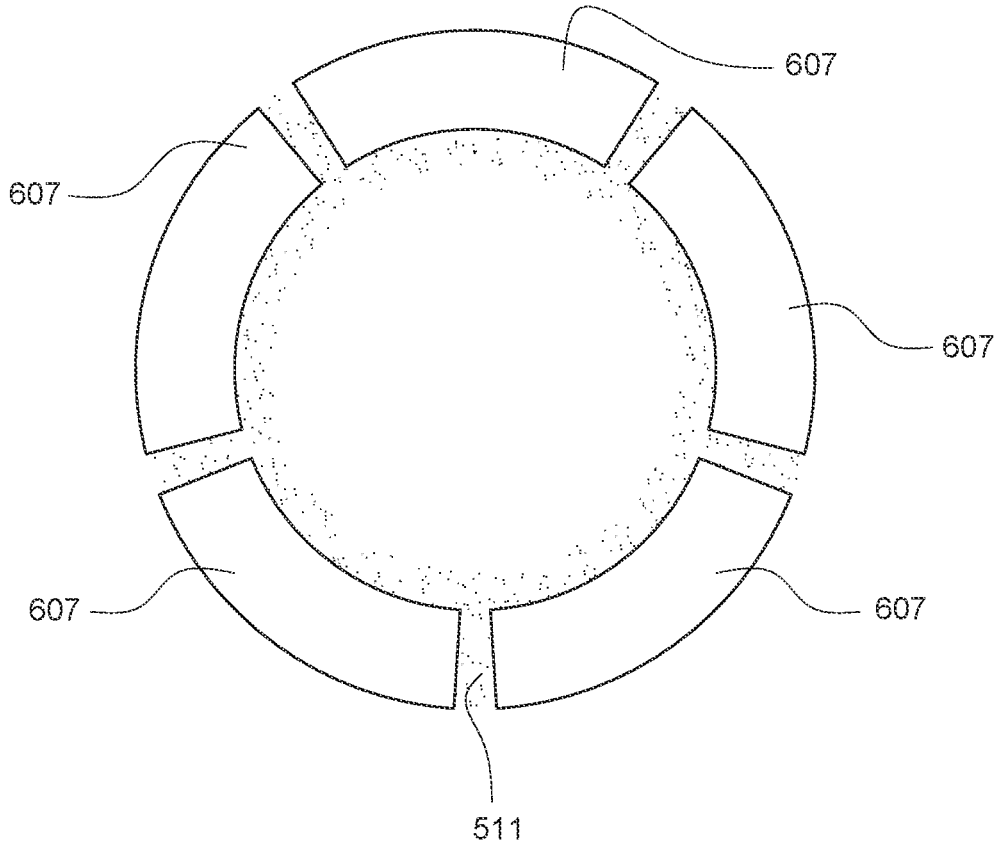

FIGS. 10*a* to 10*f* depict top cut-away views of a variety of shapes of panes and membrane walls forming a circular wall of a vessel. In FIG. 10*a*, the panes 601 have an external concave area that is not overlapped by a frame 510 that separates each pane from its surrounding pane(s), and wherein the panes are of identical shapes and sizes. FIG. 10*b* alters the FIG. 10*b* in that the external surface of each pane forms a contiguous flat external plane and internal plane, and wherein the panes are of identical shapes and sizes. FIG. 10*c* alters FIG. 10*b* in that the panes are of different lengths and otherwise identical. FIG. 10*d* alters FIG. 10*b* in that the shapes of each pane are identical to each other pane, but are asymmetrically designed from the exterior to their interior. FIG. 10*e* is an additional depiction of different size panes integrally connected into a single flexible pane/frame architectural structure wherein patterns of panes of different shapes are utilized to create optimized internal deformations according the location and amount of external pressure imposed on the pane/frame. FIG. 10*f* is an alternate depiction of FIG. 10*b* wherein each of the pane shapes do not include a circumference area of overlap for the frame, but, instead are simply separated by the frame.

Figure 11:
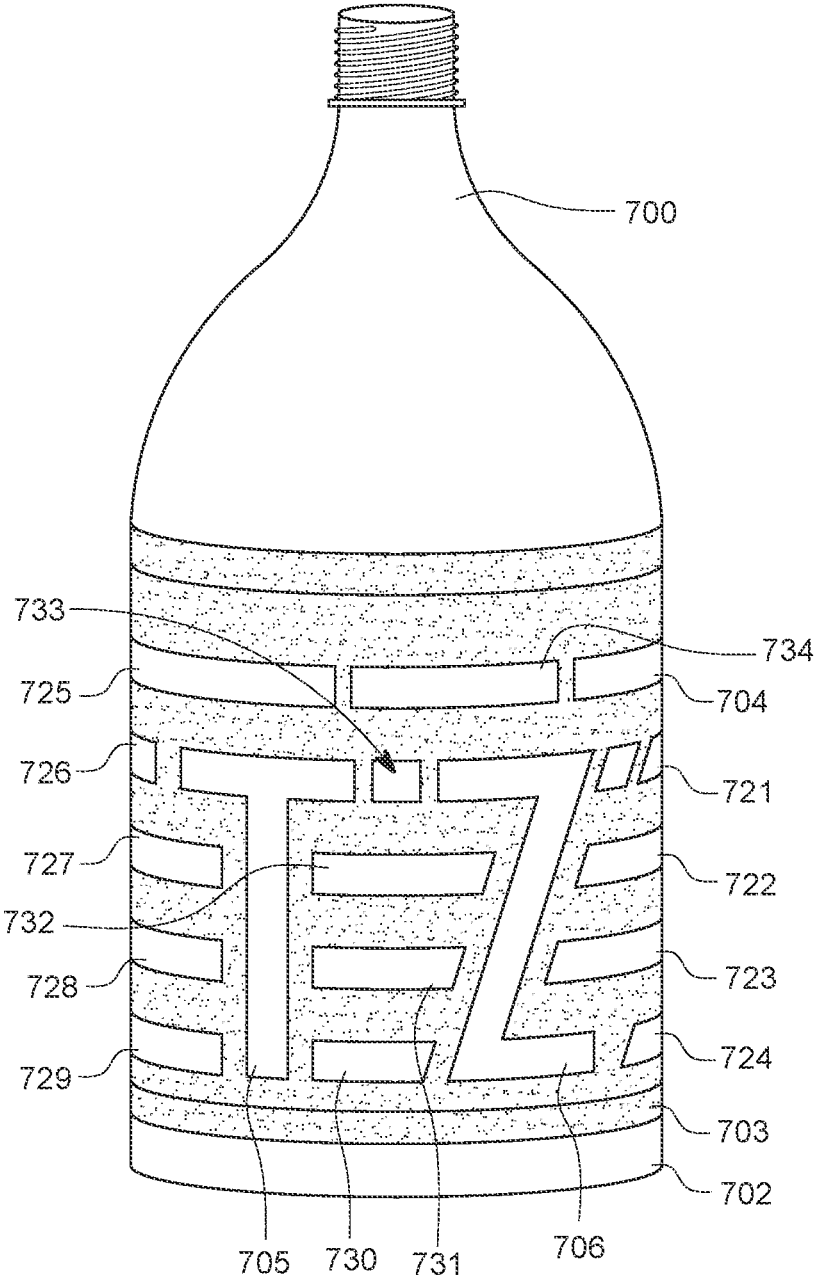
FIG. 11 depicts a perspective view of a short, round vessel with panes of a variety of shapes held in place by a resilient frame.

FIG. 11 depicts a side view of a short, round vessel with panes of a variety of shapes. Panes 705 and 706 consist of shapes that extend above, below and among an array of other-shaped panes, all flexably and elastically and liquid-sealably connected by and separate by a frame 703, and combined with a top piece 700 and a bottom base piece 702.

Figure 12A:
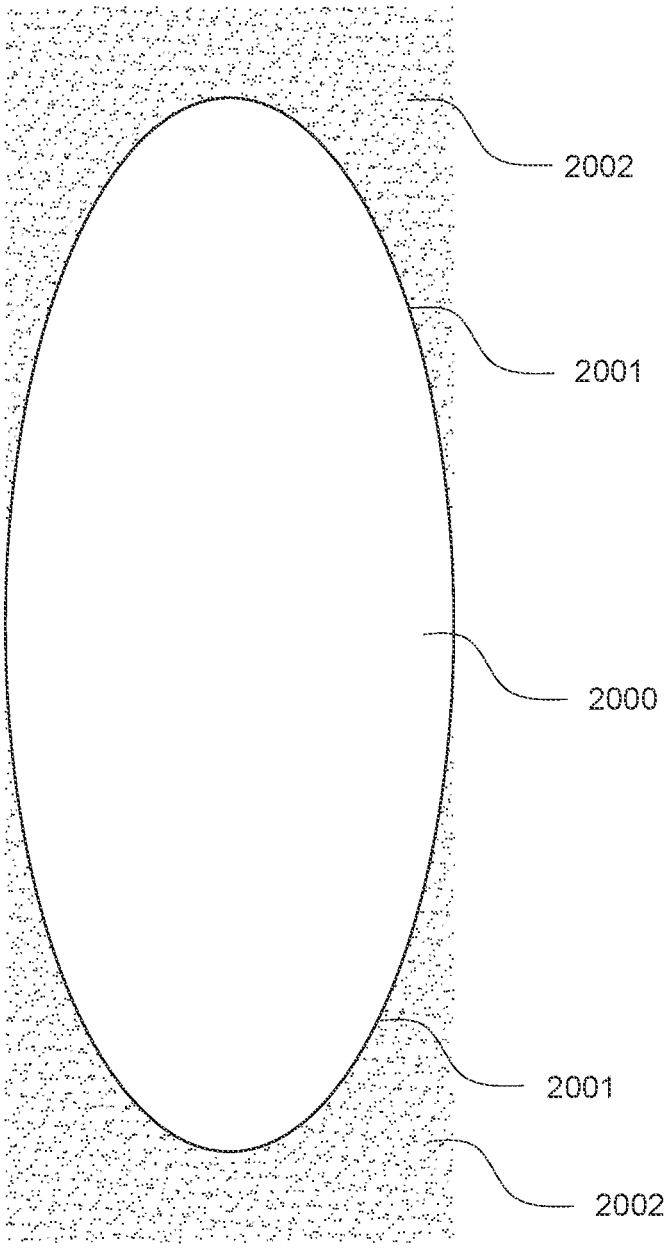
FIGS. 12*a* and 12*b* depict a side view and a top view of an ovoid pane with overlap of frame.
Figure 12B:
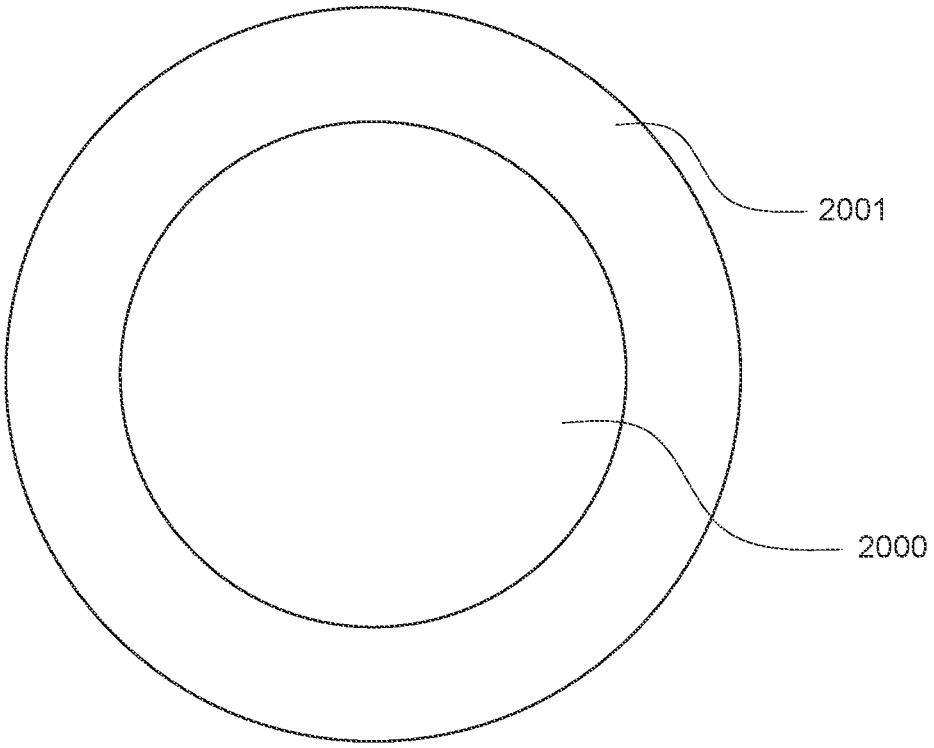

FIGS. 12*a* and 12*b* depict a side view and a top view of an ovoid pane 2000 with circumference area 2001 that overlaps with and attaches to a frame 2002.

Figure 13A:
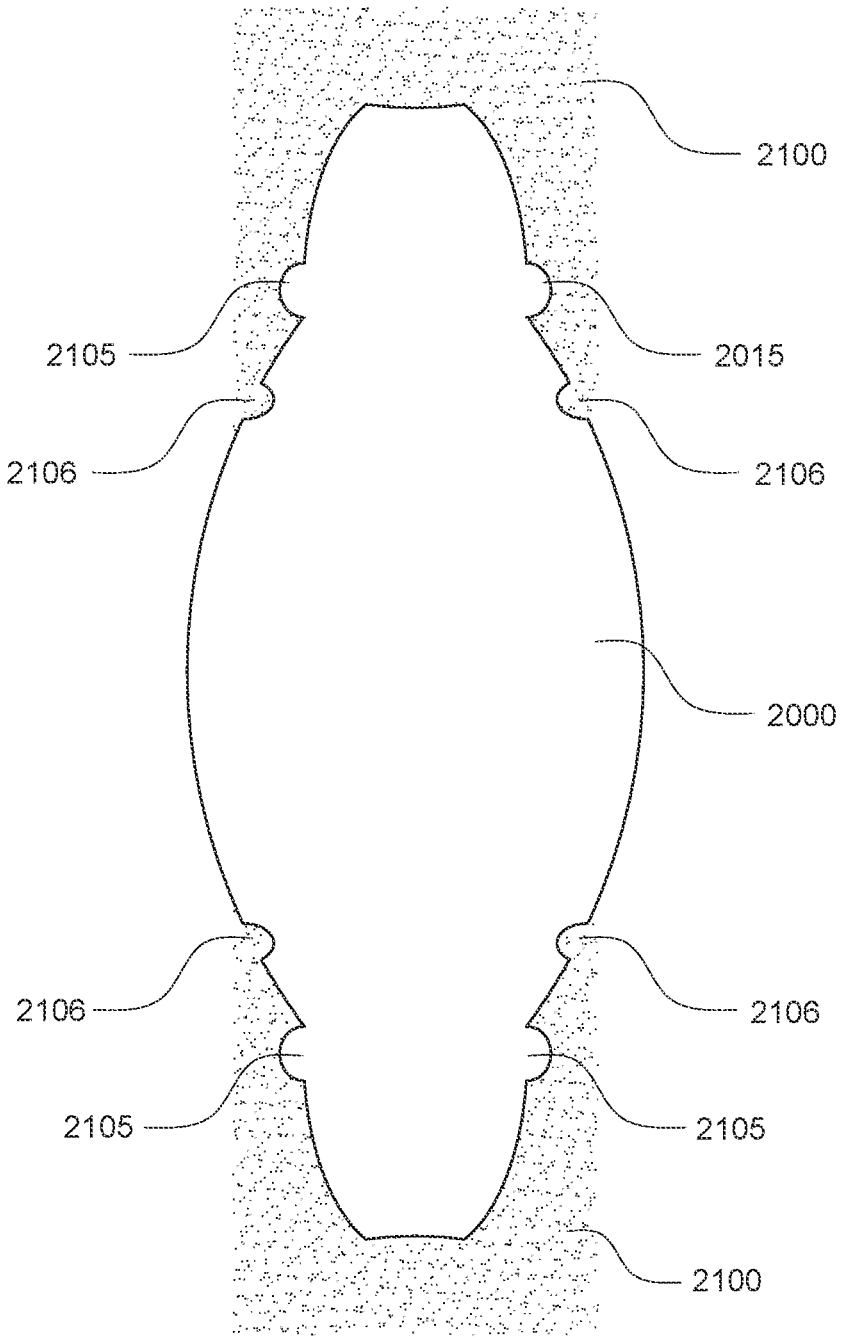
FIGS. 13*a* and 13*b* depict a side view and a top view of an ovoid pane with protrusions and indents on the top and bottom of its periphery in the zone of the pane where the frame overlaps.
Figure 13B:
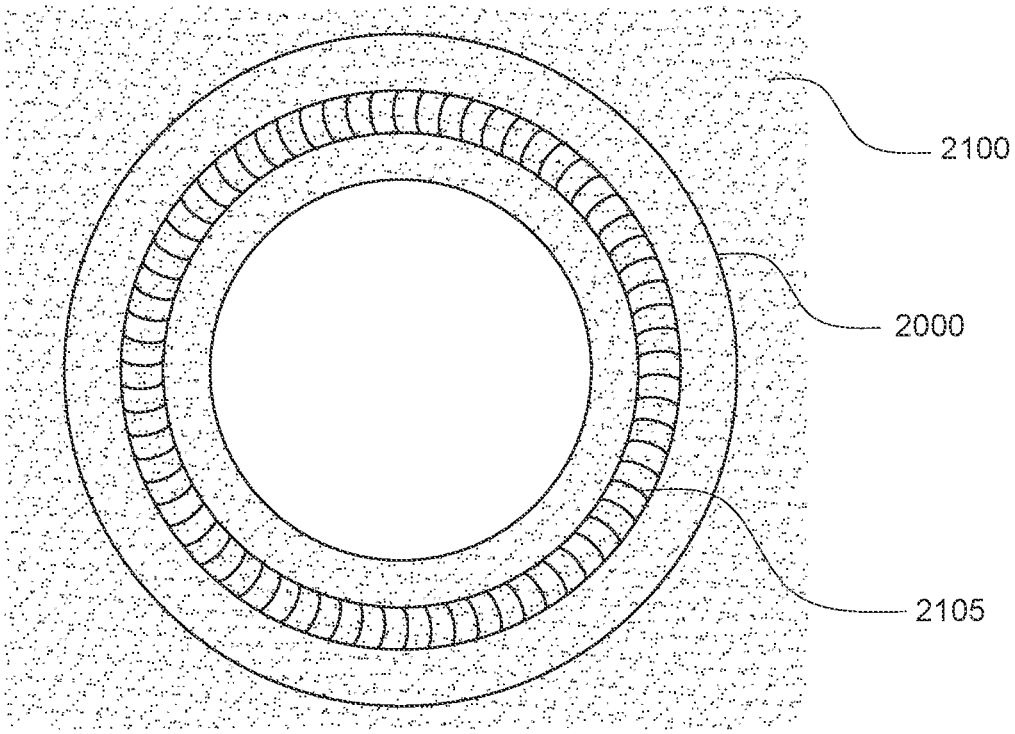

FIGS. 13*a* and 13*b* depict a side view and a top view of an ovoid pane 2000 with protrusions 2105 and indents 2016 on the top and bottom of its periphery in the zone of the pane where a frame 2100 overlaps.

Figure 14A:
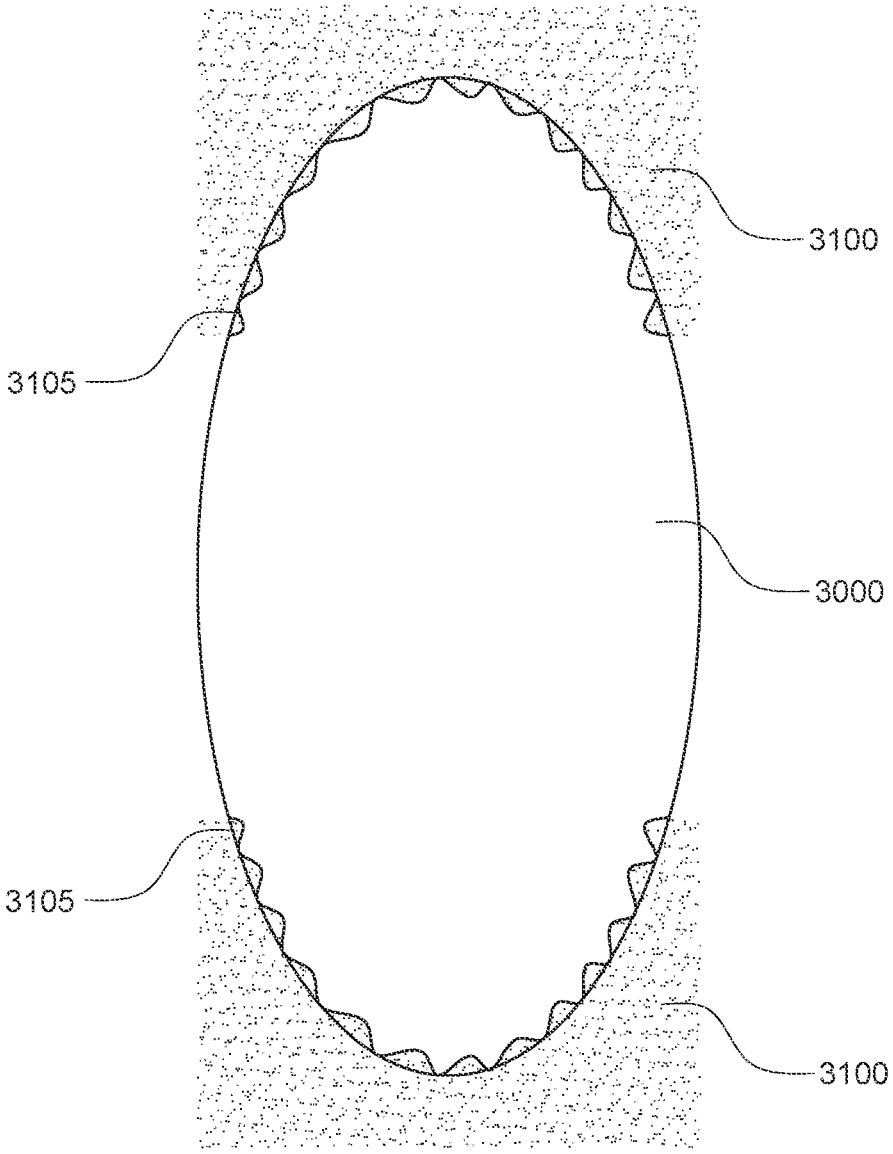
FIGS. 14*a* and 14*b* depict a side view of a side view and a top view of an ovoid pane with roughened area on the top and bottom of its periphery in the zone of the pane where the frame overlaps.
Figure 14B:
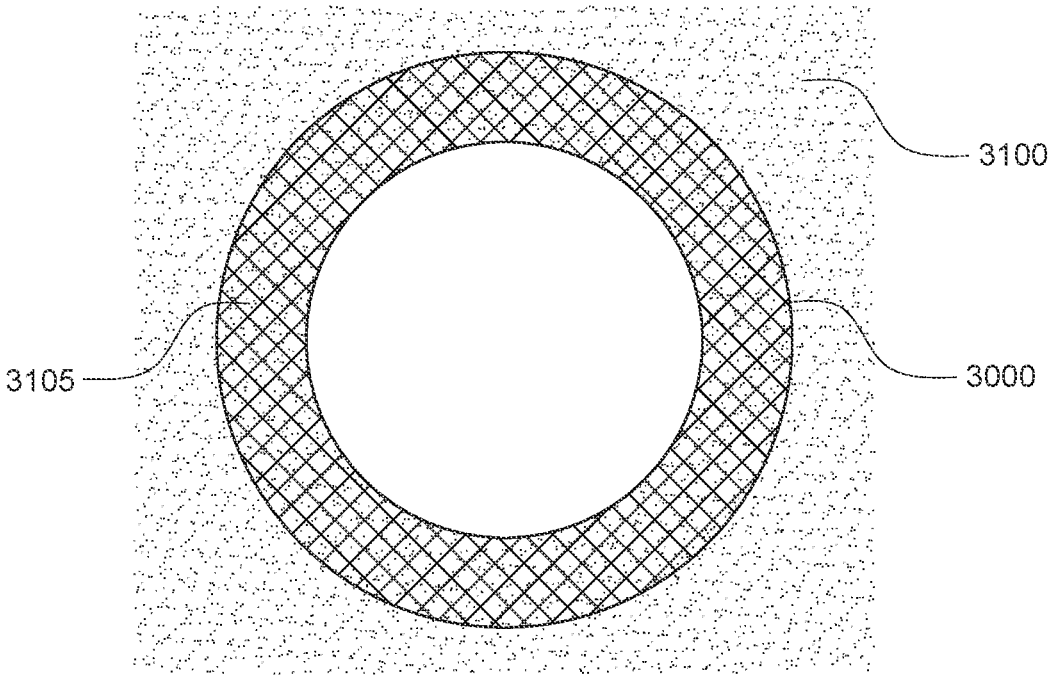

FIGS. 14*a* and 14*b* depict a side view of a side view and a top view of an ovoid pane 3000 with roughened area 3105 on the top and bottom of its periphery in the zone of the pane where a frame 3100 overlaps.

Figure 15:
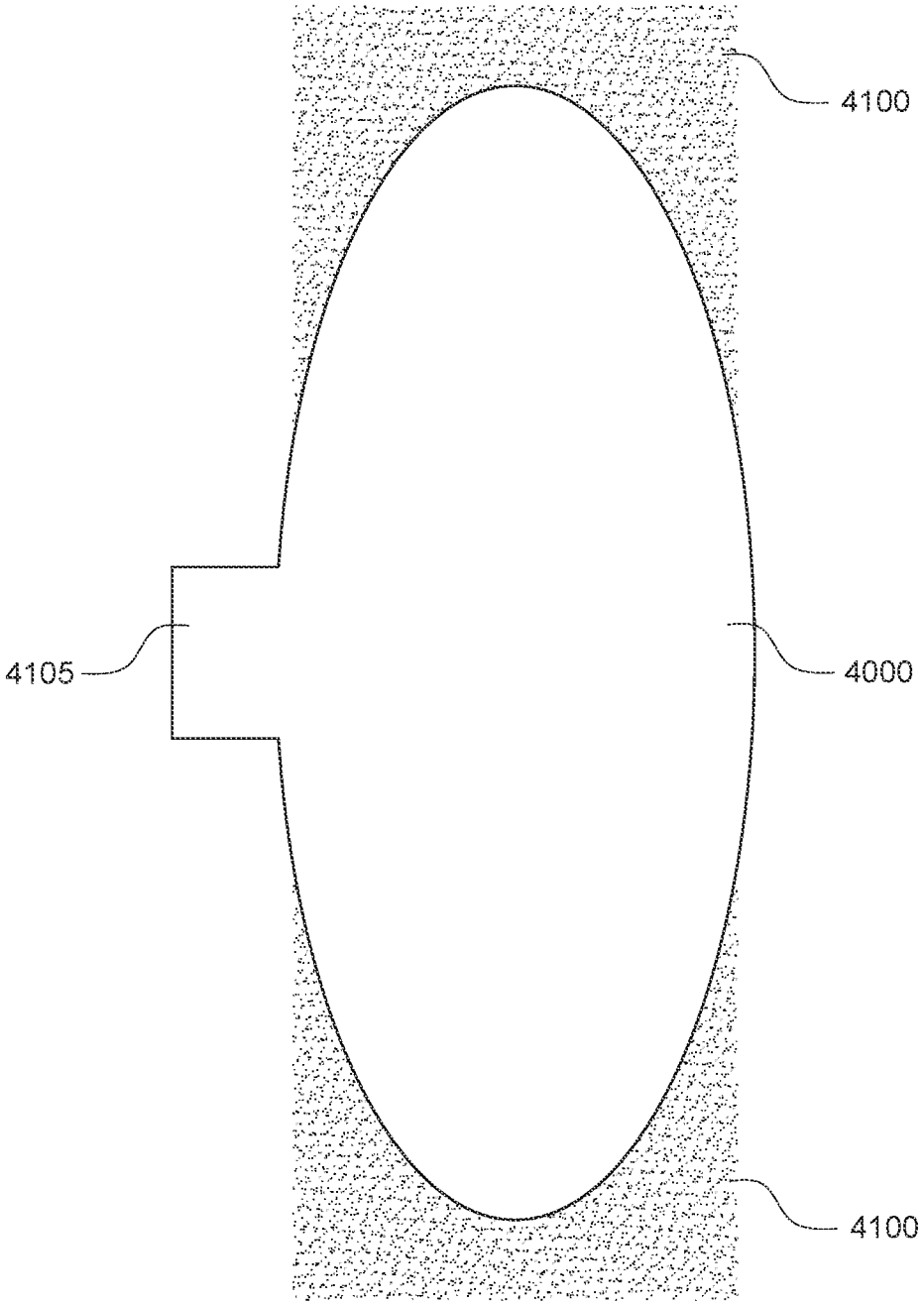
FIG. 15 depicts a side view of a pane wherein a raised area on one side (exterior side of the vessel) extends above the plane of the pane in the area of the pane where the frame does not overlap.

FIG. 15 depicts a side view of a pane 4000 wherein a raised area 4105 on one side (exterior side of the vessel) extends above the plane of the pane in the area of the pane where a frame 4100 does not overlap.

Figure 16:
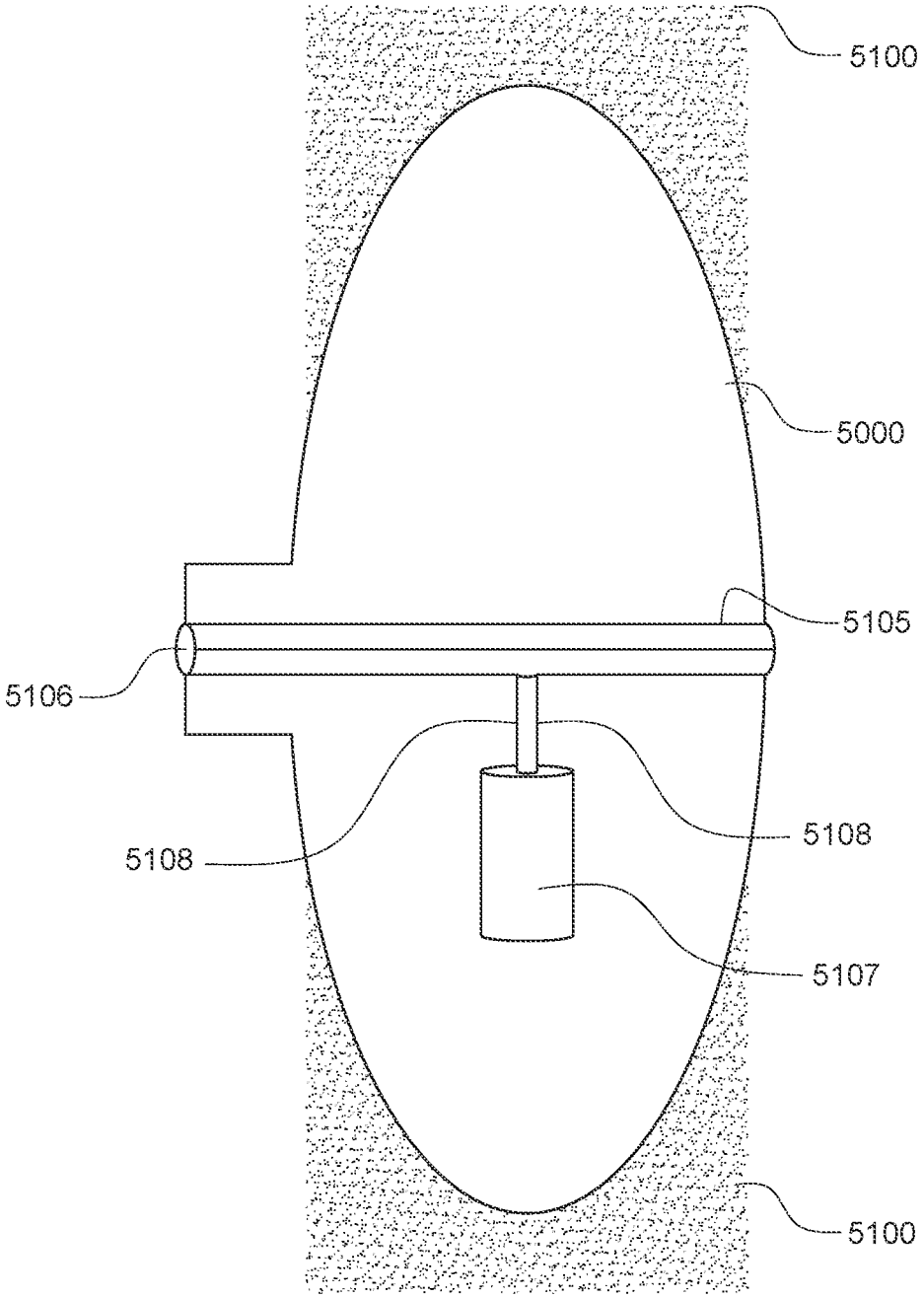
FIG. 16 depicts a side view a pane wherein the pane contains embedded electronic components.

FIG. 16 depicts a side view of a pane 5000 that contains a set of electronic components 5105, 5107, 5108 internal to the pane and an electronic component 5106 external to the pane, and further wherein the pane contains an overlap area, wherein the pane is attached to a flexible/elastic frame material 5100 and wherein the combination of pane and frame are sealed for purposes of capturing the internal contents (liquids, gasses, etc) of the vessel of which the pane/frame form all or part of an external wall/enclosure. Electronic component 5106 may be a light emitting diode, a connection port, a camera or other component. Electronic component 5107 may be a battery, including a battery re-chargeable by wireless/proximity means, a programmable CPU, a wireless receiver/transmitter or any combination of the foregoing. Component 5015 may reach the interior surface of the pane directly or sufficiently such that, for instance, the component in the form of a temperature instrumentation monitors the interior temperature of the contents of a vessel and, for instance, the componentry alters the display of the light-emitting diode (or other digital display) on the external surface of the pane to indicate, depict or display the internal temperature. This, for instance, could be utilized in a vessel to monitor and display (and/or wirelessly transmit) the internal temperature or pressure (or other mission-sensitive characteristics) (or indication thereof) of a gas, wine, coffee or other contents in accordance with programmed temperature guides. One or more panes of the pane/frame array are capable of being wirelessly connected to each other and/or to remote sources to report on the state of the vessel and/or its contents, as well as to receive instructions/commands to take action, such as to initiate a heating sequence, change the external lighting patterns (stead-to-flashing, green-to-red, "hello" to "welcome [name]". The reception of these instructions may be wireless via near field communications or other wireless communications methods. By allocating one or a set of panes in a pane/frame matrix with these capabilities, while the one or more other panes in the pane/frame array do not, design, manufacturing and other characteristics/specifications of the vessel are highly dynamic based on functional need.

Figure 17:
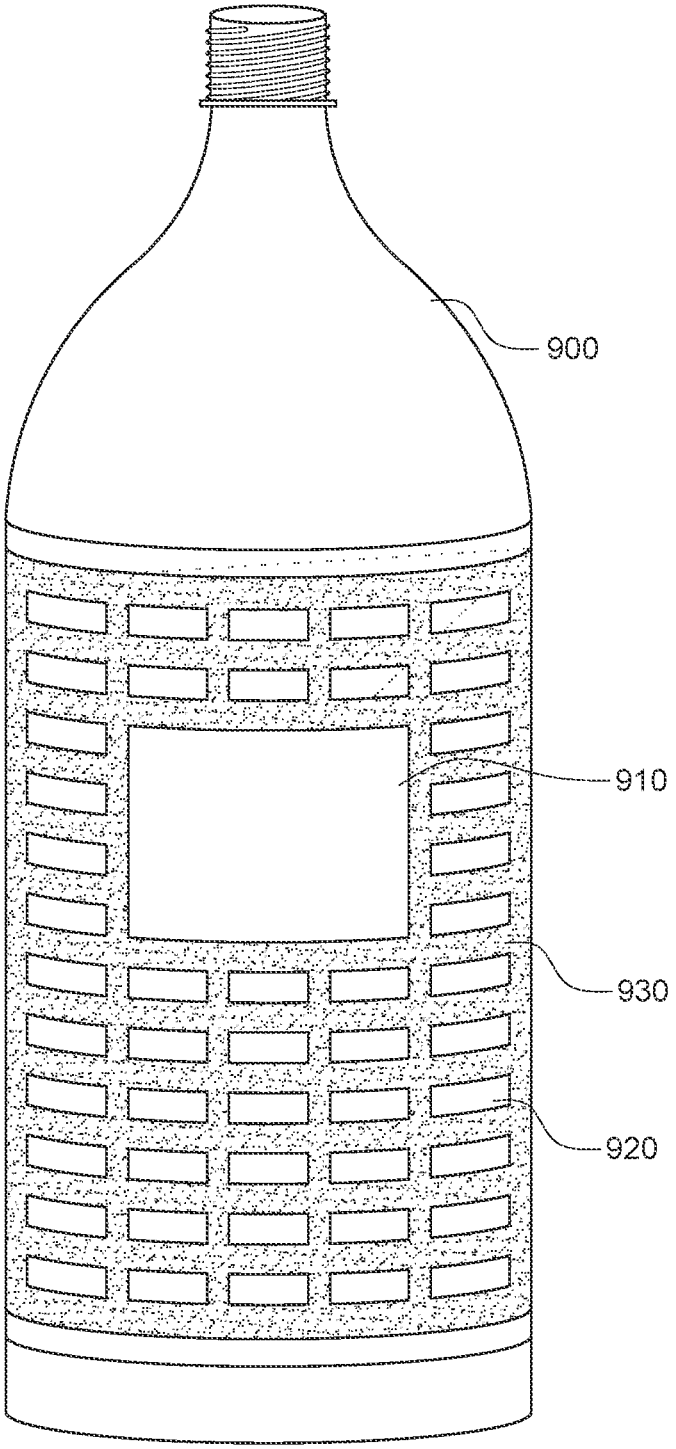
FIG. 17 depicts a side view of a vessel including a rigid top and bottom integrally connected rigidly, with a matrix of identical panes and flexible frame interposed in and comprising a side of the vessel.

FIG. 17 depicts a side view of vessel 900 consisting of a rigid top and bottom integrally connected rigidly, with a matrix of identical panes 920 and flexible frame 930 interposed in and comprising a side of the vessel 900 wherein the overall pane/frame matrix further includes a large rectangular pane 910. This implementation serves to provide a contiguous rigid structure for the vessel on two sides while on the side(s) with the pane/frame matrix, the vessel is deformable/squeezable.

Figure 18:
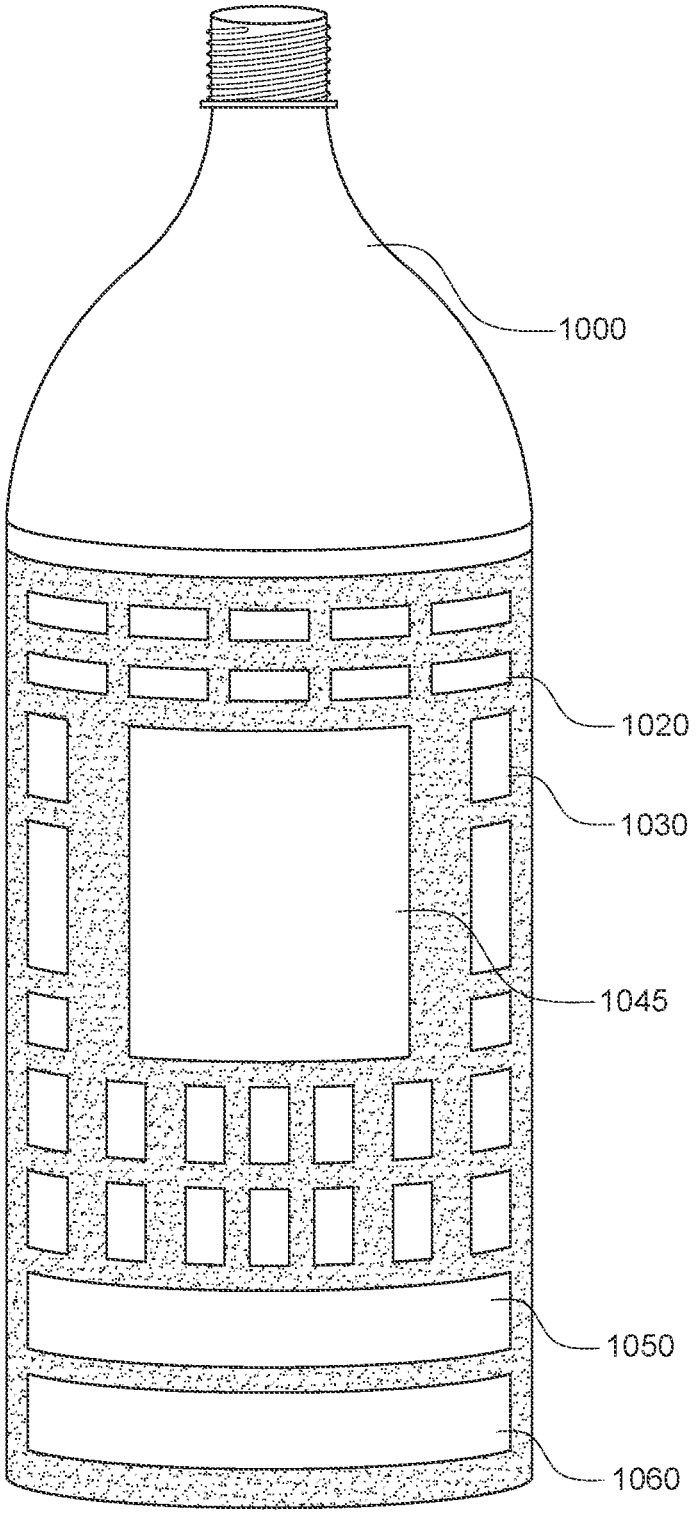
FIG. 18 depicts a side view of a vessel including a rigid top and bottom integrally connected rigidly, with a matrix of various size and shape panes and flexible frame interposed in and comprising a side of the vessel.

FIG. 18 depicts a further alternate view of a vessel as in FIG. 17 consisting of a rigid top and bottom which integrally connected rigidly, with a matrix pane/frame matrix/array consisting of various size and shape panes 1020, 1030, 1045, 1050 and flexible frame 1060 interposed in and comprising a side of the vessel.

Figure 19:
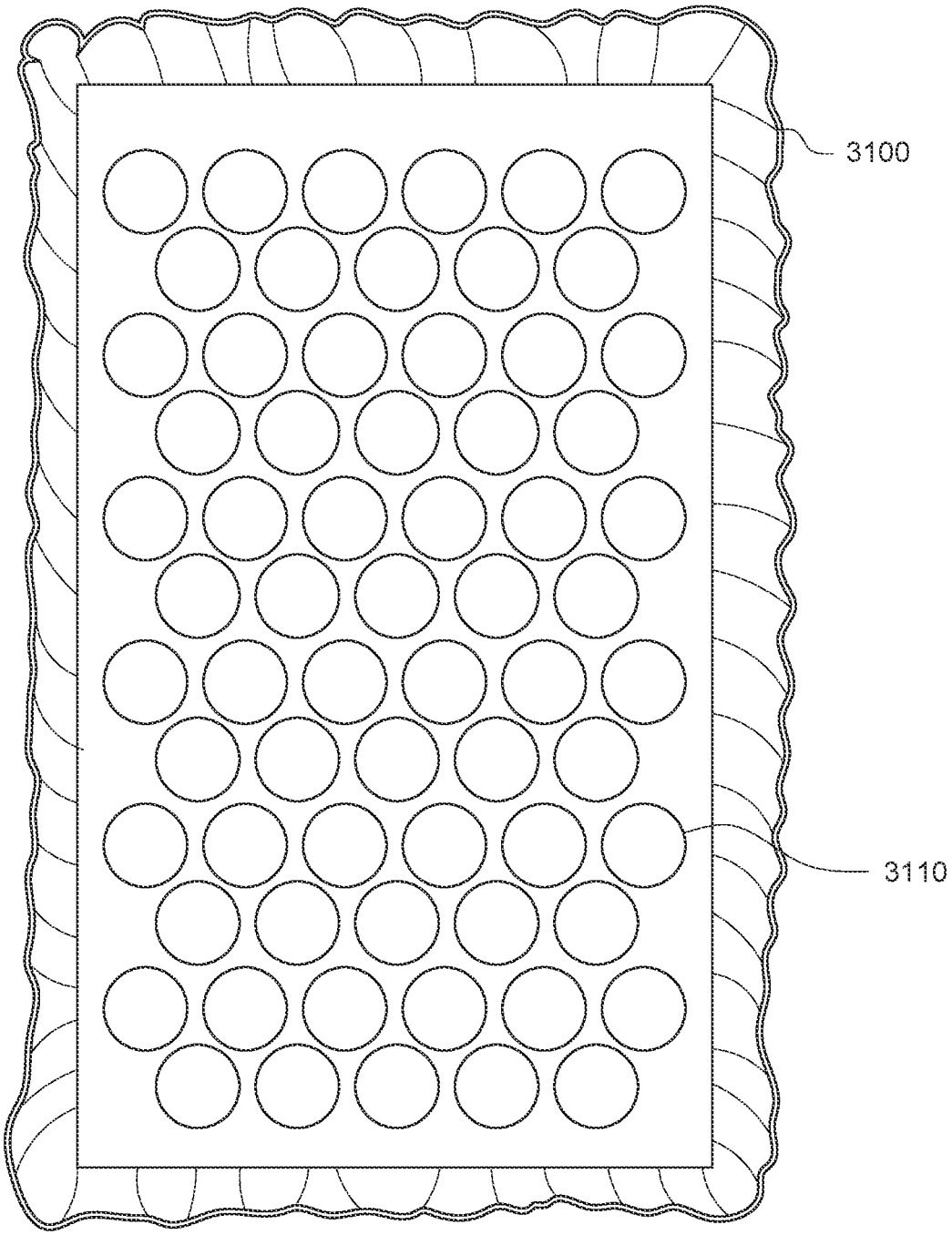
FIG. 19 depicts a top view of a manufacturing tray with panes prior to a pour of a fluid-state resilient membrane.

FIG. 19 depicts a top view of a manufacturing tray 3100 with panes 3110 prior to a pour of a fluid-state resilient membrane. This instance depicts an array of similarly spaced, identically-shaped panes 3110 in a flat tray 3100 which tray has a flat bottom and vertical sides with bottom material of clay-like material such that the panes are pressed therein sufficient to embed that portion of them to a depth wherein their underneath domed (or other shaped) surface will be clear of the poured resilient frame. The circular and rounded glass panes 3110 are shaped with symmetrically domed top and bottom surfaces such that the resilient frame material (when poured and solidified) surrounds and attaches to the external above-and-below circumference surface area of each of the panes, but not the top and bottom central domed areas. The combination of panes and resilient frame, when removed from the tray, are attached to form the deformable sidewall of a vessel with a bottom portion (e.g. circular panel) and a pourable top portion as in the earlier figures.

Figure 20:
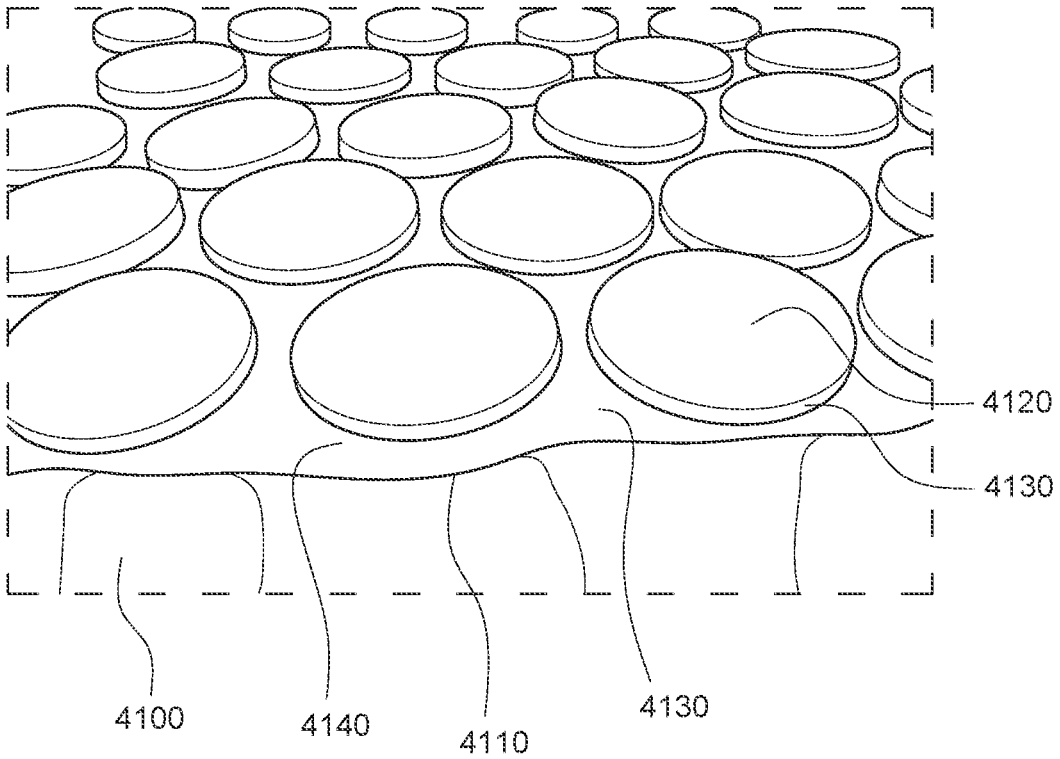
FIG. 20 depicts a partial, side view of a manufacturing tray with panes prior to a pour of a fluid-state resilient membrane.

FIG. 20 depicts a partial, side view of a manufacturing tray 4100 with panes prior to a pour of a fluid-state resilient membrane. The tray's floor 4110 consists of clay-like material such that the panes are pressably embedded at a depth such that the central domed underside is protected from being covered by a poured resilient frame material. As such, FIG. 20 depicts an open area 40120 underneath each rounded glass pane where a resilient frame material flows until hardened, while protecting the each pane's center domed (or other shaped) area that is embedded in the tray's floor surface from being enveloped by the resilient frame flow and thereby not covered by the resilient frame once it solidifies. Each pane in FIG. 20 incorporates an edge 4130 of rounded glass. Each pane 4120 is further depicted as constructed with domed top and bottom surfaces.

Figure 21:
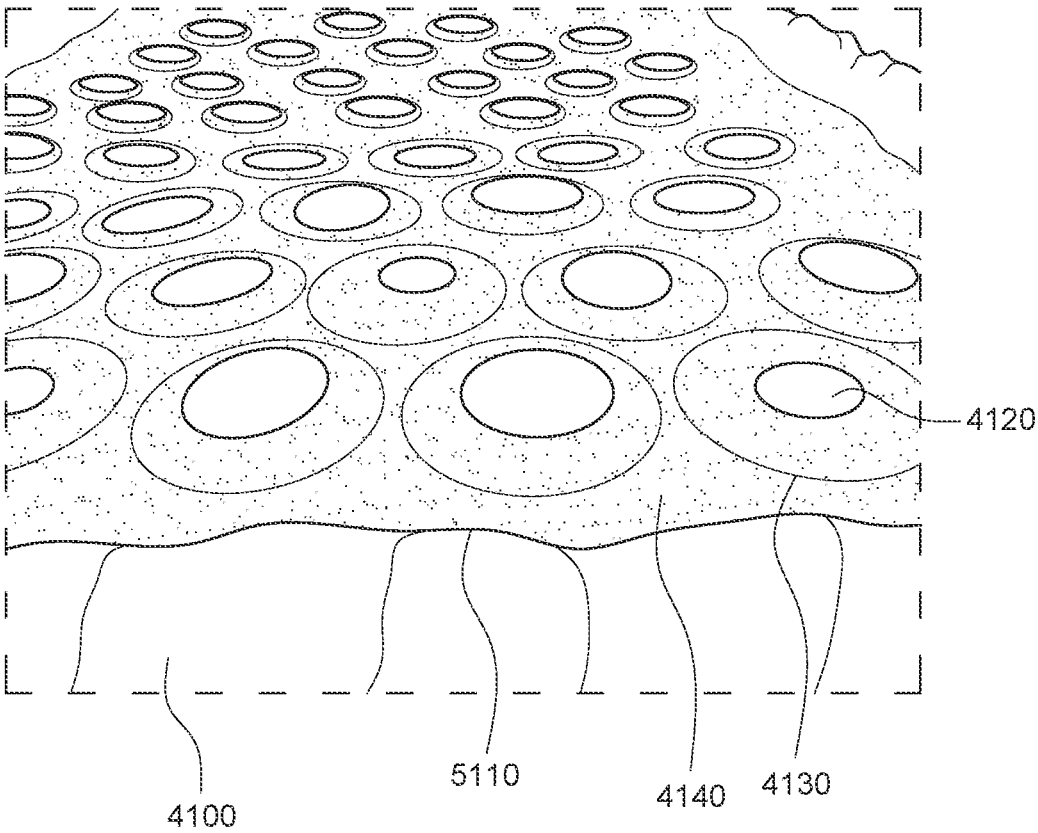
FIG. 21 depicts a partial, side view of a manufacturing tray with panes after a pour of a mimicked fluid-state resilient membrane.

FIG. 21 depicts a partial, side view of a manufacturing tray with panes similar to as depicted in FIGS. 19 and 20, but AFTER a pour of a (mimicked) clear fluid-state resilient frame material 5110 before such frame material has hardened. In the provided figures, water is used to aid visability of the overlapping relation between the panes and the frame material in the provided photographs. However, in an actual manufacturing operation, a material, such as silicone, is provided as the fluid-state frame material that cures/solidifies to form the resilient flexible material of the disclosed article of manufacture. By utilized a fluid-state resilient frame material, such material flows to all the areas of each pane where the resilient frame material is intended to sealably attach with appropriately designed pane surface areas covered (and not covered) by the frame material prior to the frame material solidifying.

Figure 22:
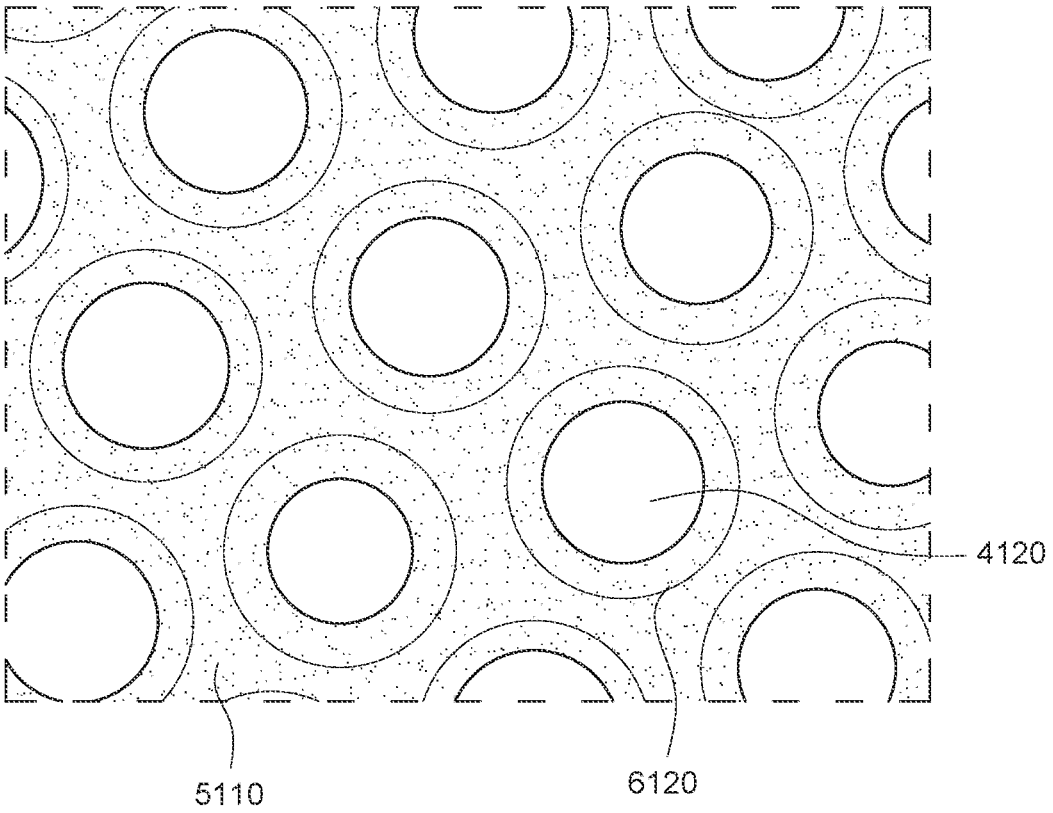
FIG. 22 depicts a partial, top view of a manufacturing tray with panes after a pour of a mimicked fluid-state resilient membrane.

FIG. 22 depicts a partial, top view of a manufacturing tray with panes after a pour of a mimicked clear fluid-state resilient frame material 5110 and before such material has solidified.

Figure 23:
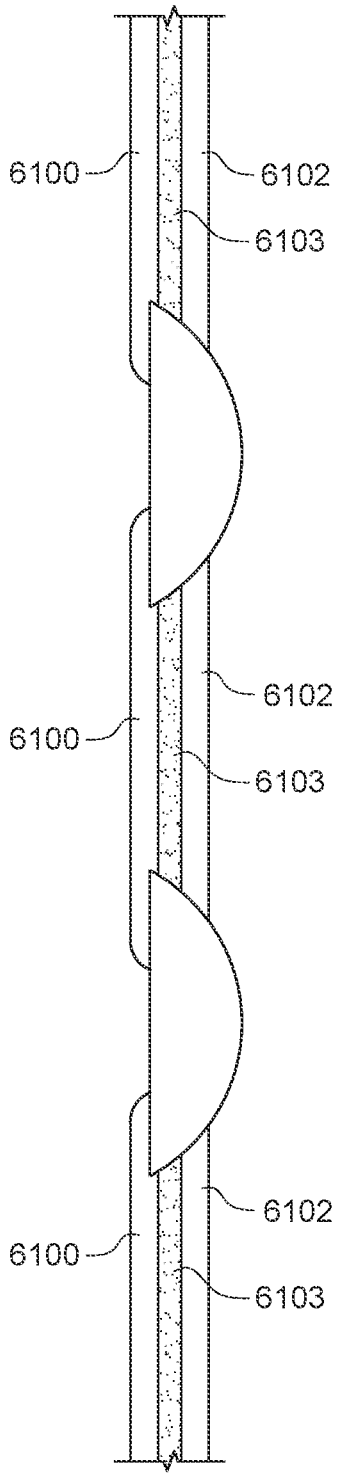
FIGS. 23-26 depict cross-sectional views of various implementation of the frame material in accordance with the disclosure.

FIG. 23 illustratively depicts an exemplary cross-section side cut-away view of the frame material wherein the frame material is a laminate of distinct/differing layers made of different materials. In this implementation, each of the layers making up the frame material is constructed of different flexible materials. Each layer has properties that, when joined together with other layers to form the frame material, create a flexible membrane with a combination of characteristics (e.g., structural, strength, elasticity, food/water safe, attachability to the tiles, biodegradable, water resilient, conductivity, insulation) required for forming a specific vessel type having particular physical properties. For instance, an innermost layer 6100 is a material that provides a beverage (e.g. drinking water) safe layer. A middle layer 6103 provides structural stability, and an external layer 6102 provides a scratch-resilient exterior surface for a vessel formed of the frame material. Whereas, in this FIG. 23, each of the layers 6100, 6102 and 6103 is depicted as having a similar and uniform depth, any specific implementation with specifications requiring (or optimized therefor) may utilize layers with different relative/absolute thicknesses and/or varying thicknesses along their lengths. Additionally, there may be implementations with specifications specifying/needing the frame material to have fewer than three layers or more than three layers.

Figure 24:
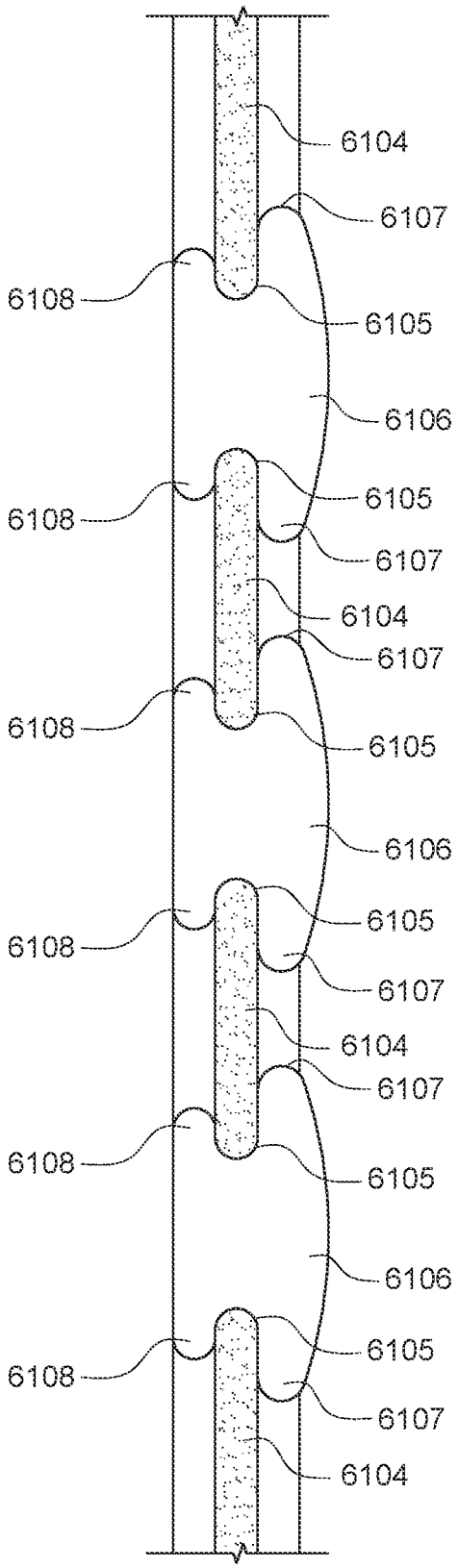

FIG. 24 depicts a particular implementation of a cross-section view as described in FIG. 23 wherein a middle layer 6104 extends into a cavity 6015 in an edge of each tile 6106 for an additional attachment mechanism of the laminated flexible membrane material to each tile 6106. The tiles 6106 in this illustrative example have an asymmetrical inside edge 6108 and outside edge 6107 surface that form the cavity 6105.

Figure 25:
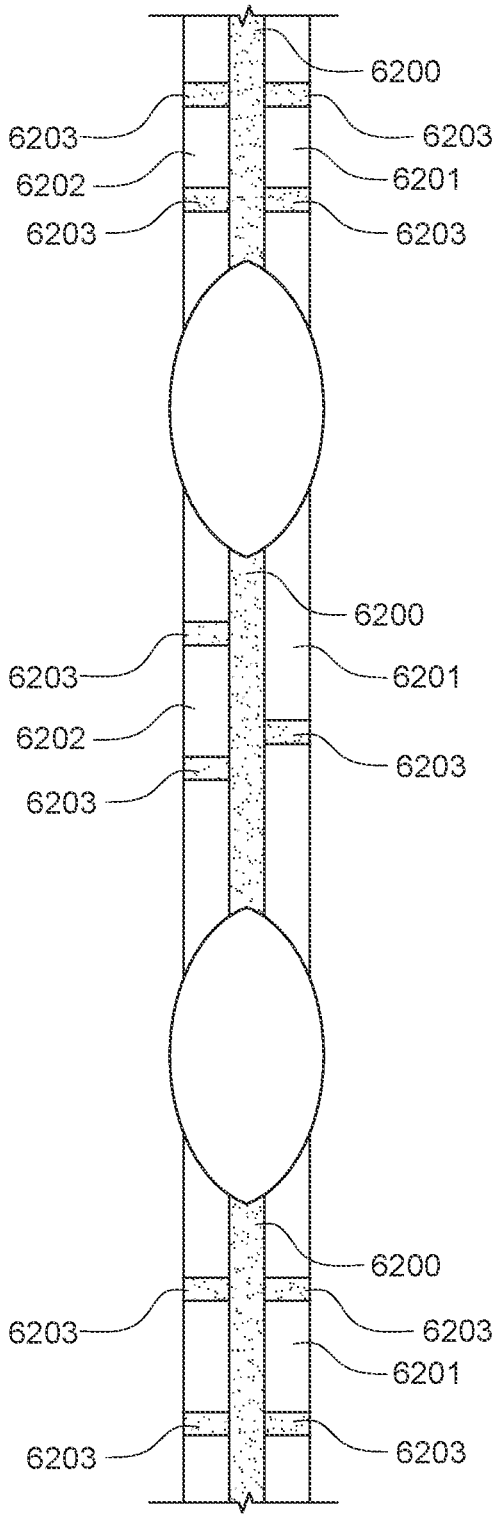

FIG. 25 depicts another particular implementation of a cross-section view as described in FIG. 23 wherein a layer (in this FIG. 25, a middle layer 6200) has extension points 6203, of a same material as the middle layer 6200, that intermittently extend through either or both of the innermost 6202 and outermost 6201 layers (in this FIG. 25, both).

Figure 26:
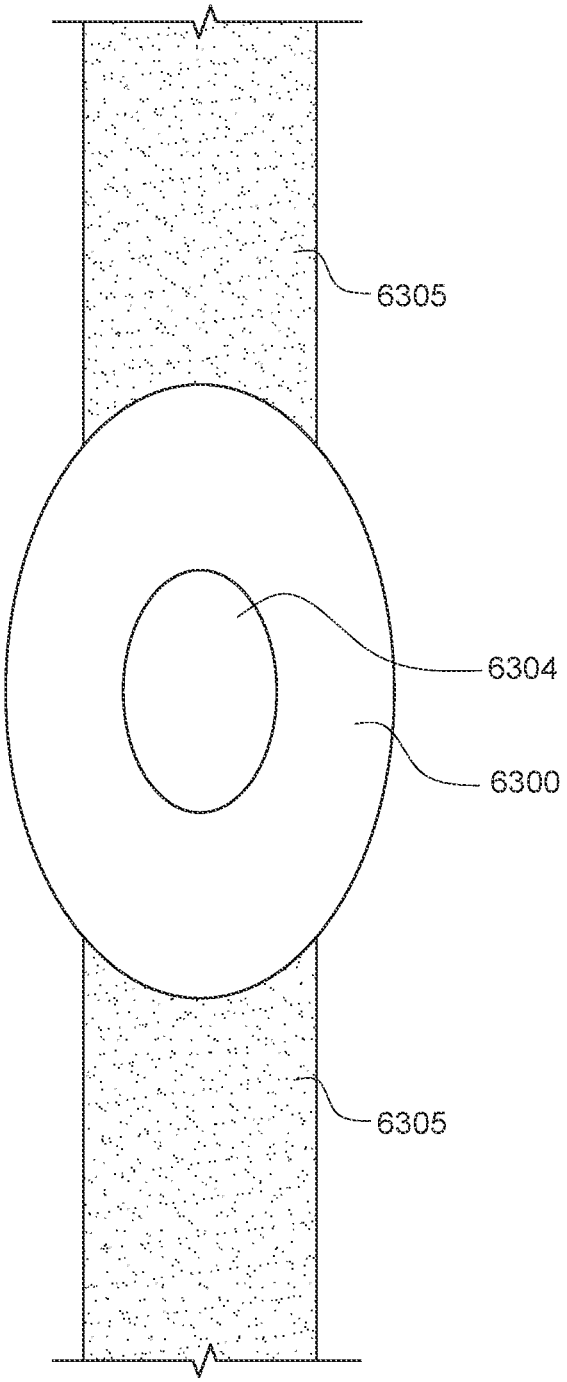

FIG. 26 depicts yet another particular implementation of a cross-section view of a symmetric tile 6300 with a hollow volume 6304 inside the tile 6300, and a flexible membrane 6305 surrounding the tile 6300. The hollow volume 6304 internal to the tile 6300 provides multiple additional benefits, such as (a) lighter weight tiles, which for a vessel with tiles constructed of glass reduces the overall weight of the vessel, and (b) additional insulation characteristics for contents inside the vessel.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted in the context. The terms "comprising," "having," "including" and "containing" are to be construed as open-ended terms (i.e., meaning "including, but not limited to") unless otherwise noted. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Illustrative examples of invention are described herein, including the best mode known to the inventor for carrying out the invention. Variations of those illustrative example embodiments may become apparent to those of ordinary skill in the art upon reading the foregoing description. The inventor expects skilled artisans to employ such variations as appropriate, and the inventor intends for the invention to be practiced otherwise than as specifically described herein. Accordingly, this invention includes all modifications and equivalents of the subject matter recited in the claims appended hereto as permitted by applicable law. For example, the flexible resilient frame may be constructed of silicon rubber, natural rubber, flexible foam non-woven material, various forms of plastic, and/or other resilient materials as applicable to the particular use-case and specifications of any particular vessel.

Moreover, any combination of the above-described elements in all possible variations thereof is encompassed by the invention unless otherwise indicated herein or otherwise clearly contradicted by context. Accordingly, the invention should only be limited by the appended claims and equivalents thereof, which claims are intended to cover such other variations and modifications as come within the spirit and scope of the invention.

What is claimed is:

1. A container vessel comprising a resiliently deformable wall having a surface area where a majority of the surface area is occupied by a plurality of rigid panes connected by a resilient continuous flexible interstitial material, wherein the plurality of rigid panes are arranged as a matrix comprising multiple rows and multiple columns of the rigid panes, wherein individual rigid panes, of the matrix, are separated by and connected to the resilient continuous flexible interstitial material, and wherein the container vessel is resiliently arranged to:

deform, during application of an external force to the resiliently deformable wall, from a non-collapsed shape to a collapsed shape, and resiliently return, upon removal of the external force to the resiliently deformable wall, from the collapsed shape to the non-collapsed shape.

2. The container of claim 1 comprising a top component provided as a separate rigid structure that is connected to the plurality of rigid panes and forms a neck and an opening of the vessel.

3. The container of claim 1 comprising a base component provided as a separate rigid structure that is connected to the plurality of rigid panes and forms a base of the vessel.

4. The container of claim 1 wherein the rigid panes are of a variety of shapes and sizes.

5. The container of claim 1 wherein the rigid panes are constructed of glass.

6. The container of claim 1 wherein the rigid panes are constructed of aluminum.

7. The container of claim 2 wherein the top component is constructed of glass.

8. The container of claim 2 wherein the top component is constructed of aluminum.

9. The container of claim 2 wherein the top component is constructed of one material, and wherein the container vessel further comprises a screw cap constructed of a different rigid material.

10. The container of claim 3 wherein the base component is constructed of glass.

11. The container of claim 3 wherein the base component is constructed of aluminum.

12. The container of claim 1 wherein the resilient continuous flexible interstitial material is constructed of rubber.

13. The container of claim 1 wherein the resilient continuous flexible interstitial material is attachably connected to the rigid panes by overlapping an outer circumference of individual ones of the plurality of rigid panes.

* * * * *